US007664426B2

(12) United States Patent
Nishimura et al.

(10) Patent No.: US 7,664,426 B2
(45) Date of Patent: Feb. 16, 2010

(54) METHOD OF REUSING DEVELOPING DEVICE USED IN IMAGE-FORMING DEVICE

(75) Inventors: Soichiro Nishimura, Handa (JP); Shougo Sato, Seto (JP); Fumikazu Sato, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 391 days.

(21) Appl. No.: 11/334,468

(22) Filed: Jan. 19, 2006

(65) Prior Publication Data

US 2006/0159485 A1 Jul. 20, 2006

(30) Foreign Application Priority Data

Jan. 19, 2005 (JP) ..... 2005-011787

(51) Int. Cl.
*G03G 15/00* (2006.01)

(52) U.S. Cl. ..... 399/109

(58) Field of Classification Search ..... 399/109, 399/119, 111, 222, 265, 279
See application file for complete search history.

(56) References Cited

U.S. PATENT DOCUMENTS

| | | | | |
|---|---|---|---|---|
| 4,890,504 | A * | 1/1990 | Carrigan et al. | 74/458 |
| 5,288,152 | A * | 2/1994 | Davies | 384/220 |
| 5,402,207 | A * | 3/1995 | Michlin | 399/117 |
| 5,461,464 | A * | 10/1995 | Swain | 399/159 |
| 5,655,182 | A * | 8/1997 | Sanchez et al. | 399/117 |
| 6,490,426 | B1 | 12/2002 | Zaman | |
| 6,763,210 | B2 | 7/2004 | Sato et al. | |
| 7,043,180 | B2 * | 5/2006 | Askren et al. | 399/265 |
| 7,054,577 | B2 * | 5/2006 | Rogers et al. | 399/109 |
| 7,162,181 | B2 * | 1/2007 | Maeshima et al. | 399/109 |
| 2003/0170046 | A1 | 9/2003 | Sato et al. | |

FOREIGN PATENT DOCUMENTS

| | | | |
|---|---|---|---|
| EP | 1 345 091 | A2 | 9/2003 |
| JP | 08194348 | A * | 7/1996 |
| JP | A 09-274420 | | 10/1997 |
| JP | 10171332 | A * | 6/1998 |
| JP | 11013857 | A * | 1/1999 |
| JP | A 11-327286 | | 11/1999 |
| JP | A 2001-51523 | | 2/2001 |
| JP | A 2003-263029 | | 9/2003 |

* cited by examiner

*Primary Examiner*—Robert Beatty
(74) *Attorney, Agent, or Firm*—Oliff & Berridge, PLC

(57) ABSTRACT

A method of reusing a developing device that can be detachably mounted in a body of an image-forming device includes: preparing a used developing device that includes a developer-carrying member that carries a developer thereon, and a gear mechanism having a plurality of gears that transfer a driving force inputted from the image-forming device to the developer-carrying member; and replacing at least one gear in the gear mechanism with at least one replacement gear that has stronger gear teeth, gear teeth that have a larger module, or gear teeth that have a greater working depth than the at least one original gear.

45 Claims, 14 Drawing Sheets

METHOD OF REUSING DEVELOPING DEVICE USED IN IMAGE-FORMING DEVICE

CROSS REFERENCE TO RELATED APPLICATIONS

This application claims priority from Japanese Patent Application No. 2005-11787 filed Jan. 19, 2005. The entire content of the priority application is incorporated herein by reference.

TECHNICAL FIELD

The disclosure relates to a method of reusing or recycling a developing device used in an image-forming device such as a laser printer or the like, the developing device, and the image-forming device.

BACKGROUND

Conventional electrophotographic image-forming devices such as laser printers employ developer cartridges filled with toner. The developer cartridges are detachably mounted in the image-forming device.

This type of developer cartridge is partitioned into a filling chamber and a developing chamber. The filling chamber is filled with toner and includes an agitator that is driven to rotate therein. The developing chamber is provided with a supply roller and a developing roller disposed in contact with each other, and a thickness-regulating blade that applies pressure to the surface of the developing roller.

When the developer cartridge is mounted in the laser printer and the laser printer inputs power to the cartridge via a gear train, the agitator is driven to rotate and, by such rotations, conveys toner accommodated in the filling chamber into the developing chamber. The rotating supply roller in the developing chamber supplies this toner onto the developing roller, at which time the toner is tribocharged between the supply roller and the developing roller. As the developing roller continues to rotate, the toner supplied onto the surface of the developing roller passes between the thickness-regulating blade and the developing roller, at which time the toner is smoothed so that a thin layer of uniform thickness is carried on the developing roller.

This type of developer cartridge is mounted in the laser printer so that the developing roller opposes a photosensitive drum in the laser printer. As the thin layer of toner carried on the surface of the developing roller rotates opposite the photosensitive drum, the toner develops an electrostatic latent image formed on the surface of the photosensitive drum into a visible image. A transfer roller disposed in confrontation with the photosensitive drum causes the visible image to be transferred onto a sheet of paper as the sheet passes between the transfer roller and the photosensitive drum, thereby forming a desired image on the paper.

By mounting this type of developer cartridge in the laser printer and using the cartridge as described above, toner accommodated in the filling chamber is consumed. When the amount of toner remaining in the chamber becomes low, the user removes the used developer cartridge and inserts a new developer cartridge in its place.

Owing to the increasing trend toward environmental conservation in recent years, it is desirable that the used developer cartridges be recycled rather than discarded.

For example, U.S. Pat. publication No. 6,763,210 B2 proposes a method of reusing a used developer cartridge. In this method, the used developer cartridge is recovered and refilled with a toner having less fluidity than the suspension polymerized toner previously used in the developer cartridge, and greater fluidity than a crushed toner that has not undergone spherical processing, that is, an emulsion polymerized toner, or a suspension polymerized toner containing less additive than the suspension polymerized toner originally used in the developer cartridge.

SUMMARY

However, the rotational shafts of the developing roller, supply roller, and the like and the bearings that rotatably support these rotational shafts gradually wear down through extended use of the developer cartridge and produce fine shavings. These shavings can accumulate between the rotational shafts and the respective bearings, increasing the torque applied to the gears fixed to the rotational shafts. As the wear progresses, the rotational shafts may begin to wobble, which increases the torque applied to the gear.

Other rotational shafts provided integrally in the developer cartridge and gears rotatably mounted on the rotational shafts also wear after extended use of the developer cartridge, resulting in increased torque applied to the gears.

If the same rotational shafts and bearings are kept when reusing the developer cartridge, a greater torque would be applied to the gears linked to the rotational shafts than the first time the developer cartridge has been used. This increased torque may lead to slippage among the gears.

Japanese unexamined patent application publication No. HEI-11-327286 proposes a driving device for electrically charging toner through friction generated between the supply roller and developing roller, wherein the gears to which a high torque is applied are formed of a resin material reinforced with glass fiber. This construction prevents the gears from slipping and the gear teeth from becoming damaged when a high load is applied to the gears.

However, new developer cartridges are not always recycled after being used once for one of the following reasons: (1) the developer cartridge is damaged in an accident before being recycled and is discarded without being reused; (2) the user accidentally discards the developer cartridge, even though the cartridge has never been reused; and (3) some users prefer to use only new cartridges that have not been reused.

Therefore, when manufacturing new developer cartridges, it is not desirable from an environmental perspective to use a material such as resin containing glass fibers that is difficult to recycle, requires complex manufacturing steps, and is costly to manufacture. Further, if the manufacturing process is unnecessarily complex, the manufacturing costs will also rise.

In view of the foregoing, it is an object of the invention to provide a method of reusing a developing device that prevents gear slippage when the developing device is being reused and that does not require gears that are complex and costly to manufacture and that are burdensome to the environment when manufacturing new developing devices that have not yet been reused.

In order to attain the above and other objects, the invention provides a method of reusing a developing device that can be detachably mounted in a body of an image-forming device, the method including: preparing a used developing device that includes a developer-carrying member that carries a developer thereon, and a gear mechanism having a plurality of gears that transfer a driving force inputted from the image-forming device to the developer-carrying member; and replacing at least one gear in the gear mechanism with at least one replacement gear that has stronger gear teeth than the at least one original gear.

According to another aspect, the invention provides a method of reusing a developing device that can be detachably mounted in a body of an image-forming device, the method including: preparing a used developing device that includes a developer-carrying member that carries a developer thereon, and a gear mechanism having a plurality of gears that transfer a driving force inputted from the image-forming device to the developer-carrying member; and replacing a set of gears that are engaged with one another among the plurality of gears with a set of replacement gears that are engaged with one another and that have gear teeth with a greater working depth than the original gears.

According to another aspect, the invention provides a method of reusing a developing device that can be detachably mounted in a body of an image-forming device, the method including: preparing a used developing device that includes a developer-carrying member that carries a developer thereon, and a gear mechanism having a plurality of gears that transfer a driving force inputted from the image-forming device to the developer-carrying member, the plurality of gears including a set of gears that are engaged with one another, one gear in the set of gears being fixed on a rotational shaft, the set of gears having an original gear ratio that determines an original peripheral velocity of the one gear; and replacing the set of gears with a set of replacement gears that are engaged with one another, one of the replacement gears being fixed on the rotational shaft in place of the one gear in the original set of gears, the replacement gears having a replacement gear ratio that determines a replacement peripheral velocity of the one of the replacement gears lower than the original peripheral velocity, an amount of force applied to the rotational shaft opposing its rotation being greater during reuse than before reuse.

According to another aspect, the invention provides a method of reusing a developing device that can be detachably mounted in a body of an image-forming device, the method including: preparing a used developing device that includes a housing, a developer-carrying member that is rotatably supported by the housing and that carries a developer thereon, and a gear mechanism having a plurality of gears that are rotatably supported by the housing and that transfer a driving force inputted from the image-forming device to the developer-carrying member, the plurality of gears including a developer-carrying-member drive gear fixed on a rotational shaft of the developer-carrying member, and an input gear that is engaged with the developer-carrying-member drive gear and that transfers a driving force inputted from the image-forming device to the developer roller drive gear, the developer-carrying-member drive gear and the input gear having an original gear ratio that determines an original peripheral velocity of the rotational shaft of the developer-carrying member; and replacing the developer-carrying-member drive gear and the input gear with a set of replacement gears that are engaged with each other, without replacing other gears in the gear mechanism, the set of replacement gears having a replacement gear ratio that determines a replacement peripheral velocity of the rotational shaft of the developer-carrying member that is lower than the original peripheral velocity.

According to another aspect, the invention provides a method of reusing a developing device that can be detachably mounted in a body of an image-forming device, the method including: preparing a used developing device that includes a developer-carrying member that carries a developer thereon, and a gear mechanism having a plurality of gears that transfer a driving force inputted from the image-forming device to the developer-carrying member; and replacing a set of gears that are engaged with one another among the plurality of gears with a set of replacement gears that are engaged with one another and that have a larger engagement ratio than the original gears.

According to another aspect, the invention provides a method of reusing a developing device that can be detachably mounted in a body of an image-forming device, the method including: preparing a used developing device that includes a housing, a developer-carrying member that is rotatably supported by the housing and that carries a developer thereon, and a gear mechanism having a plurality of gears that are rotatably supported by the housing and that transfer a driving force inputted from the image-forming device to the developer-carrying member; and replacing, with another bearing, a bearing that is supported by the housing of the developing device and that rotatably supports a rotational shaft, on which a gear in the gear mechanism is fixed.

According to another aspect, the invention provides a method of reusing a developing device that can be detachably mounted in a body of an image-forming device, the method including: preparing a used developing device that includes a developer-carrying member that carries a developer thereon, and a gear mechanism having a plurality of gears that transfer a driving force inputted from the image-forming device to the developer-carrying member; and interposing a sliding member between a rotational shaft, on which a gear in the gear mechanism is rotatably supported, and a surface of the gear that opposes the peripheral surface of the rotational shaft.

According to another aspect, the invention provides a method of reusing a developing device that can be detachably mounted in a body of an image-forming device, the method including: preparing a used developing device that includes a housing, a developer-carrying member that is rotatably supported by the housing and that carries a developer thereon, and a gear mechanism having a plurality of gears that are rotatably supported by the housing and that transfer a driving force inputted from the image-forming device to the developer-carrying member; and executing at least one of: replacing at least one gear in the gear mechanism with a replacement gear; replacing, with another bearing, a bearing that is supported by the housing of the developing device and that rotatably supports a rotational shaft, on which a gear in the gear mechanism is fixed; and interposing a sliding member between a rotational shaft, on which a gear in the gear mechanism is rotatably supported, and a surface of the gear that opposes the peripheral surface of the rotational shaft.

According to another aspect, the invention provides a developing device that can be detachably mounted in a body of an image-forming device, the developing device including: a developer-carrying member that carries a developer thereon; and a gear mechanism having a plurality of gears that transfers a driving force inputted from the image-forming device to the developer-carrying member, the gear mechanism including at least one replacement gear that is provided in place of at least one original gear that has been provided previously, the replacement gear having stronger gear teeth than the original gear.

According to another aspect, the invention provides a developing device that can be detachably mounted in a body of an image-forming device, the developing device including: a developer-carrying member that carries a developer thereon; and a gear mechanism having a plurality of gears that transfers a driving force inputted from the image-forming device to the developer-carrying member, the gear mechanism including at least one set of replacement gears that are engaged with one another and that are provided in place of at least one set of original gears that have been provided previously in engagement with one another, the replacement gears having gear teeth with a greater working depth than the original gears.

According to another aspect, the invention provides a developing device that can be detachably mounted in a body of an image-forming device, the developing device including: a developer-carrying member that carries a developer thereon; and a gear mechanism having a plurality of gears that transfers a driving force inputted from the image-forming device to the developer-carrying member, the gear mechanism including at least one set of replacement gears that are engaged with one another and that are provided in place of at least one set of original gears that have been provided previously in engagement with one another, one of the replacement gears being fixed on a rotational shaft, an amount of force applied to the rotational shaft opposing its rotation being greater during reuse than before reuse, the replacement gears having a replacement gear ratio determining a replacement peripheral velocity of the one of the replacement gears that is lower than an original peripheral velocity that is determined by an original gear ratio in the original gears.

According to another aspect, the invention provides a developing device that can be detachably mounted in a body of an image-forming device, the developing device including: a developer-carrying member that carries a developer thereon; and a gear mechanism having a plurality of gears that transfers a driving force inputted from the image-forming device to the developer-carrying member, the plurality of gears including a developer-carrying-member drive gear fixed on a rotational shaft of the developer-carrying member, and an input gear that is engaged with the developer-carrying-member drive gear and that transfers a driving force inputted from the image-forming device to the developer roller drive gear, and the gear mechanism including at least one set of replacement gears that are engaged with one another and that are provided in place of at least one set of original gears that have been provided previously in engagement with one another, the set of replacement gears including replacement gears for the developer-carrying-member drive gear and the input gear that have a replacement gear ratio that determines a replacement peripheral velocity for the rotational shaft of the developer-carrying member lower than an original peripheral velocity that is determined by an original gear ratio in the original gears.

According to another aspect, the invention provides a developing device that can be detachably mounted in a body of an image-forming device, the developing device including: a developer-carrying member that carries a developer thereon; and a gear mechanism having a plurality of gears that transfers a driving force inputted from the image-forming device to the developer-carrying member, the gear mechanism including at least one set of replacement gears that are engaged with one another and that are provided in place of at least one set of original gears that have been provided previously in engagement with one another, the replacement gears having a larger engagement ratio than the original gears.

According to another aspect, the invention provides a developing device that can be detachably mounted in a body of an image-forming device, the developing device including: a housing; a developer-carrying member that is rotatably supported by the housing and that carries a developer thereon; a gear mechanism having a plurality of gears that are rotatably supported by the housing and that transfer a driving force inputted from the image-forming device to the developer-carrying member; and a bearing that is supported by the housing and that rotatably supports a rotational shaft, on which a gear in the gear mechanism is fixed, the bearing being provided in place of an original bearing that has been provided previously.

According to another aspect, the invention provides a developing device that can be detachably mounted in a body of an image-forming device, the developing device including: a developer-carrying member that carries a developer thereon; a gear mechanism having a plurality of gears that transfers a driving force inputted from the image-forming device to the developer-carrying member; and a sliding member interposed between a rotational shaft, on which a gear in the gear mechanism is rotatably supported, and a surface of the gear that opposes the peripheral surface of the rotational shaft.

According to another aspect, the invention provides an image forming apparatus, including: a body; and a developing device with any one of the above-described configurations.

BRIEF DESCRIPTION OF THE DRAWINGS

Illustrative aspects in accordance with the invention will be described in detail with reference to the following figures wherein:

FIG. 4(*b*) is a right side view of the developer cartridge;

FIG. 4(*c*) is a left side view of the developer cartridge;

FIG. 4(*d*) is an exploded view showing how a developing roller, a bearing, and a developing roller drive gear are assembled together;

FIG. 4(*e*) is an exploded view showing how an input gear is mounted on a rotational shaft during the original use of the input gear;

FIG. 8(*b*) is a view of the developing roller drive gear seen along the direction B after replacement of the gear;

FIG. 8(*c*) illustrates how the developing roller drive gear and a first input gear are engaged with one another after replacement thereof;

FIG. 8(*d*) is an exploded view showing how the input gear is mounted on the rotational shaft after replacement thereof;

FIG. 9(*b*) is an explanatory diagram showing the axial thickness of a replacement developing roller drive gear that is used to replace the original developing roller drive gear of FIG. 9(*a*) according to an additional aspect;

DETAILED DESCRIPTION

Figure 1:
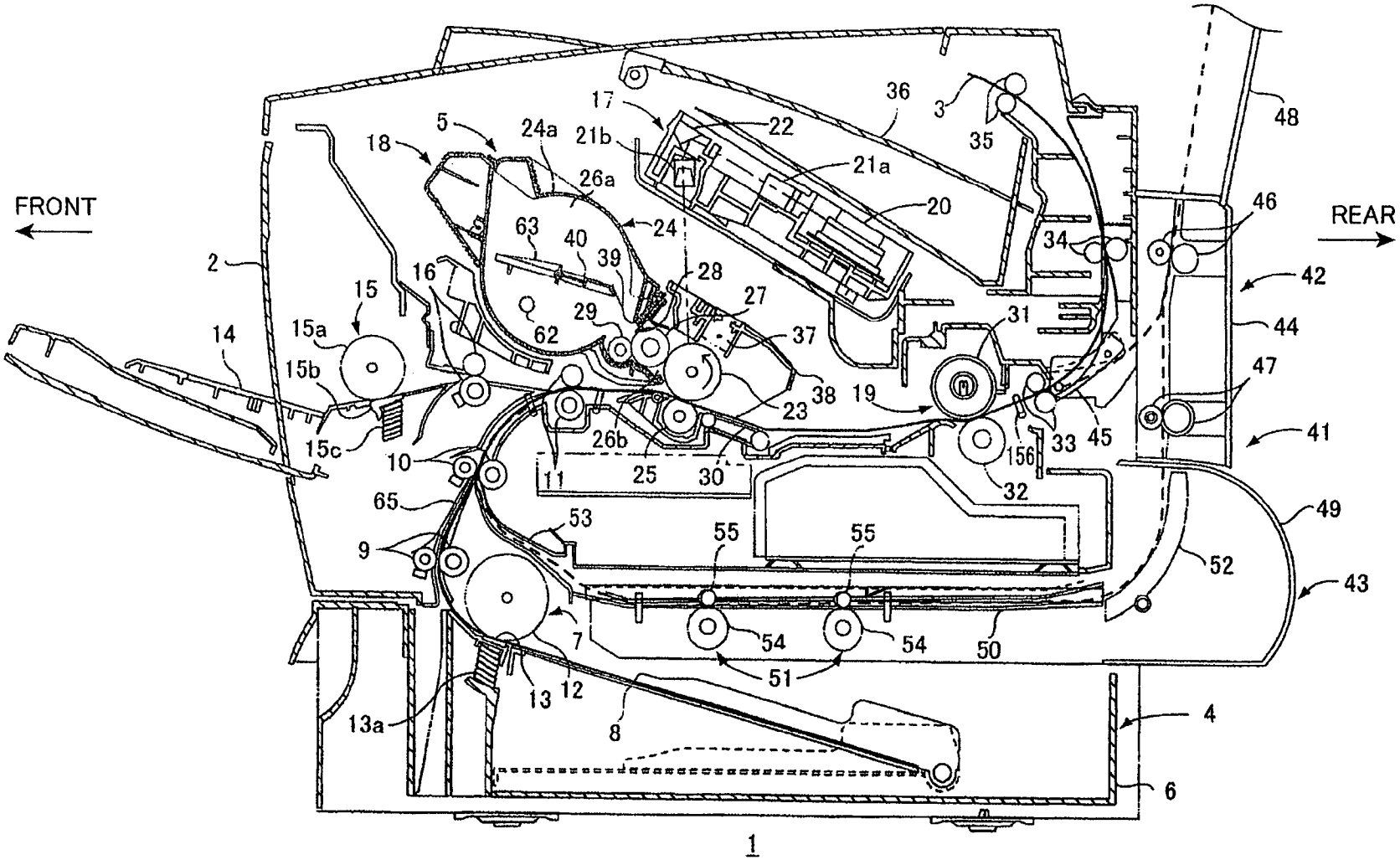
FIG. 1 is a side cross-sectional view of a laser printer according to illustrative aspects of the invention.

A developing device according to some aspects of the invention will be described while referring to the accompanying drawings wherein like parts and components are designated by the same reference numerals to avoid duplicating description.

FIG. 1 is a side cross-sectional view of a color laser printer 1 in which a developer cartridge 24 according to some aspect is mounted. In FIG. 1, the laser printer 1 employs an electrophotographic system to form images. The laser printer 1 includes a main casing 2 and, within the main casing 2, a feeding unit 4 for feeding sheets of a paper 3, an image-forming unit 5 for forming prescribed images on the paper 3 supplied from the feeding unit 4, and the like.

The feeding unit 4 is disposed in a bottom section of the main casing 2 and includes a paper tray 6 detachably mounted in the feeding unit 4, a paper feeding mechanism 7 disposed on one end of the paper tray 6, a paper-pressing plate 8 disposed in the paper tray 6, pairs of first conveying rollers 9 and second conveying rollers 10 disposed downstream of the paper feeding mechanism 7 with respect to the direction that the paper 3 is conveyed (hereinafter, upstream or downstream in the conveying direction of the paper 3 will be abbreviated simply as "upstream" or "downstream"), and a pair of registration rollers 11 provided downstream of the first and second conveying rollers 9 and 10.

The paper tray 6 has a box shape with an open top and is capable of accommodating a plurality of sheets of paper 3 stacked therein. The paper tray 6 is detachably mounted in the lower section of the main casing 2 in a horizontal direction.

The paper feeding mechanism 7 includes a feeding roller 12, a separating pad 13 disposed in opposition to the feeding roller 12, and a spring 13*a* disposed on the underside of the separating pad 13. The urging force of the spring 13*a* presses the separating pad 13 toward the feeding roller 12.

The paper 3 can be stacked in the paper tray 6 on top of the paper-pressing plate 8. The paper-pressing plate 8 is pivotably supported on an end farthest from the feeding roller 12, enabling the end nearest the feeding roller 12 to move vertically. A spring (not shown) is disposed on the underside of the paper-pressing plate 8, urging the paper-pressing plate 8 upward. As the number of sheets of paper 3 stacked on the paper 3 increases, the paper-pressing plate 8 opposes the urging force of the spring and pivots downward about a supporting point on the end farthest from the paper feeding mechanism 7. The topmost sheet of paper 3 stacked on the paper-pressing plate 8 is pressed against the feeding roller 12 by the spring disposed on the underside of the paper-pressing plate 8. The rotation of the feeding roller 12 interposes the topmost sheet of paper 3 between the feeding roller 12 and the separating pad 13 and subsequently feeds one sheet at a time in cooperation with the separating pad 13 onto a paper conveying path 65. The first and second conveying rollers 9 and 10 receive this sheet of paper 3 and convey the sheet along the paper conveying path 65 to the registration rollers 11.

After adjusting the paper 3 to a prescribed register position, the pair of registration rollers 11 convey the sheet to an image-forming position. The image-forming position is a point of contact between a photosensitive drum 23 and a transfer roller 25 described later, and more specifically a transfer position at which a toner image carried on the photosensitive drum 23 is transferred onto the paper 3.

The feeding unit 4 further includes a multipurpose tray 14 on which can be stacked sheets of paper 3 of a desired size, a multipurpose paper feeding mechanism 15 for feeding the sheets of paper 3 stacked on the multipurpose tray 14, and a pair of multipurpose conveying rollers 16.

The multipurpose paper feeding mechanism 15 includes a multipurpose feeding roller 15*a*, a multipurpose separating pad 15*b* disposed in opposition to the multipurpose feeding roller 15*a*, and a spring 15*c* disposed on the underside of the multipurpose separating pad 15*b*. The urging force of the spring 15*c* presses the multipurpose separating pad 15*b* against the multipurpose feeding roller 15*a*.

The rotation of the multipurpose feeding roller 15*a* causes the topmost sheet of paper 3 stacked on the multipurpose tray 14 to become interposed between the multipurpose feeding roller 15*a* and multipurpose separating pad 15*b*. Through the cooperative function of the multipurpose separating pad 15*b*, the multipurpose feeding roller 15*a* feeds the paper 3 one sheet at a time toward the registration rollers 11.

The image-forming unit 5 includes a scanning unit 17, a process unit 18, and a fixing unit 19.

The scanning unit 17 is disposed in an upper section of the main casing 2 and includes a laser light-emitting unit (not shown), a polygon mirror 20 that is driven to rotate, lenses 21*a* and 21*b*, and a reflecting mirror 22. The laser light-emitting unit emits a laser beam based on prescribed image data that passes through or is reflected by the polygon mirror 20, lens 21*a*, reflecting mirror 22, and lens 21*b* in sequence, as indicated by the broken line in the drawing, and is irradiated in a high-speed scan across the surface of the photosensitive drum 23 in the process unit 18 described later.

The process unit 18 is disposed below the scanning unit 17 and is detachably mounted in the main casing 2. The process unit 18 includes a drum cartridge 38 and the developer cartridge 24 detachably mounted on the drum cartridge 38. The photosensitive drum 23, the transfer roller 25, and a Scorotron charger 37 are disposed inside the drum cartridge 38.

Figure 2:
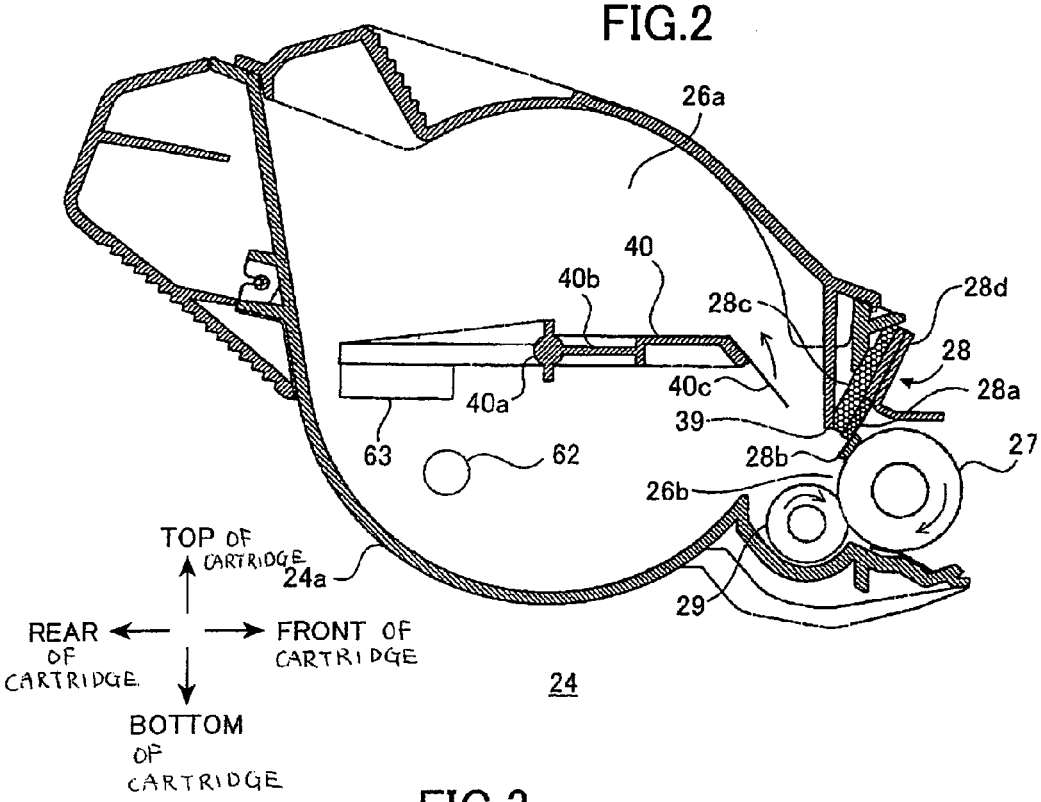
FIG. 2 is a side cross-sectional view of a developer cartridge used in the laser printer of FIG. 1.

The developer cartridge 24 can be mounted on the drum cartridge 38 irrespective of whether the drum cartridge 38 is mounted in the main casing 2 or removed therefrom. As shown in FIG. 2, the developer cartridge 24 has a casing 24*a*. The casing 24*a* is partitioned into a filling chamber 26*a* in which toner is accommodated, and a developing chamber 26*b*. A toner supply opening 39 is formed in the partitioning wall in the casing 24*a*. The side of the developer cartridge 24 where the developing chamber 26*b* is formed will be referred to as a front side of the developer cartridge 24. The filling chamber 26*a* is located rear to the developing chamber 26*b*.

The filling chamber 26*a* is filled with a non-magnetic, single-component toner with positively charging nature. An agitator 40 is rotatably provided in the filling chamber 26*a* and includes a rotational shaft 40*a* that is rotatably supported in the center of the filling chamber 26*a*, an agitating blade 40*b* that rotates around the rotational shaft 40*a*, and a film member 40*c* affixed to a free end of the agitating blade 40*b*. A gear mechanism 59 (see FIG. 4(*a*) and FIG. 4(*b*)) described later generates a motive force for driving the rotational shaft 40*a* to rotate. As the agitating blade 40*b* rotates along with the rotational shaft 40*a*, the film member 40*c* stirs up toner in the filling chamber 26*a* and conveys some of this toner to the developing chamber 26*b*. A cleaner 63 is provided on the rotational shaft 40*a* of the agitator 40 opposite the agitating blade 40*b* for cleaning windows 62 described later.

The developing chamber 26*b* houses a developing roller 27, a thickness-regulating blade 28, and a supply roller 29.

The supply roller 29 is disposed below the toner supply opening 39 and is capable of rotating in the direction of the arrow (clockwise in FIG. 2). The supply roller 29 includes a metal roller shaft covered by a roller that is formed of an electrically conductive sponge material.

The developing roller 27 is disposed to the front side of the supply roller 29 and is capable of rotating in the direction indicated by the arrow (clockwise in FIG. 2). As shown in FIG. 4(*d*), the developing roller 27 is configured of a metal roller shaft 91 covered by a roller 94 that is formed of an electrically conductive resilient material. More specifically, the roller portion 94 of the developing roller 27 is formed of an electrically conductive urethane rubber or silicone rubber including fine carbon particles or the like, the surface of which is coated with a urethane rubber or silicone rubber including fluorine. A prescribed developing bias relative to the photosensitive drum 23 is applied to the developing roller 27. The supply roller 29 and developing roller 27 contact each other with pressure so that each is compressed to a degree.

The thickness-regulating blade 28 is disposed near the developing roller 27 and opposes the surface near the top of the developing roller 27 along the axial direction.

The thickness-regulating blade 28 includes a leaf spring member 28*a*; a pressing part 28*b* provided on the distal end of the leaf spring member 28*a* as a contact part for contacting the developing roller 27, the pressing part 28*b* having a semicircular cross section and being formed of an insulating silicone rubber; a backup member 28*c* provided on the back surface of the leaf spring member 28*a*; and a support member 28*d* for supporting the rear end of the leaf spring member 28*a* on the casing 24*a* of the developer cartridge 24. With this construction of the thickness-regulating blade 28, the thickness-regulating blade 28 is supported on the casing 24*a* by the support member 28*d*, while the elastic force of the leaf spring member 28*a* pressed by the backup member 28*c* causes the pressing part 28*b* to contact the developing roller 27 with pressure.

Forming the pressing part 28*b* of the thickness-regulating blade 28 with a silicone rubber effectively charges the toner that is carried on the developing roller 27.

As shown in FIG. 4(*a*)-FIG. 4(*c*), the casing 24*a* includes two side walls 56, that is, a right-side wall 56*a* and a left-side wall 56*b*.

As shown in FIG. 4(*a*) and FIG. 4(*c*), a toner cap 60 is provided on the left-side wall 56*b* as a cover that can seal the filling chamber 26*a* or be removed to expose the filling chamber 26*a*.

As shown in FIG. 4(*a*) and FIG. 4(*b*), a gear mechanism 59 for driving the developing roller 27 and the agitator 40 is disposed on the right-side wall 56*a*, which rotatably supports the right-side axial ends of the developing roller 27 and the agitator 40 in the casing 24*a*.

It is noted that in FIG. 4(*b*), the direction A is indicated as being directed from the bottom to the top of the developer cartridge 24 and is perpendicular to the axial directions of the developing roller 27, the supply roller 29, and the agitator 40. In FIG. 4(*a*) and subsequent drawings, the direction B is indicated as being directed from the right to the left of the developer cartridge 24 along the axial directions of the developing roller 27, the supply roller 29, and the agitator 40.

Figure 3:
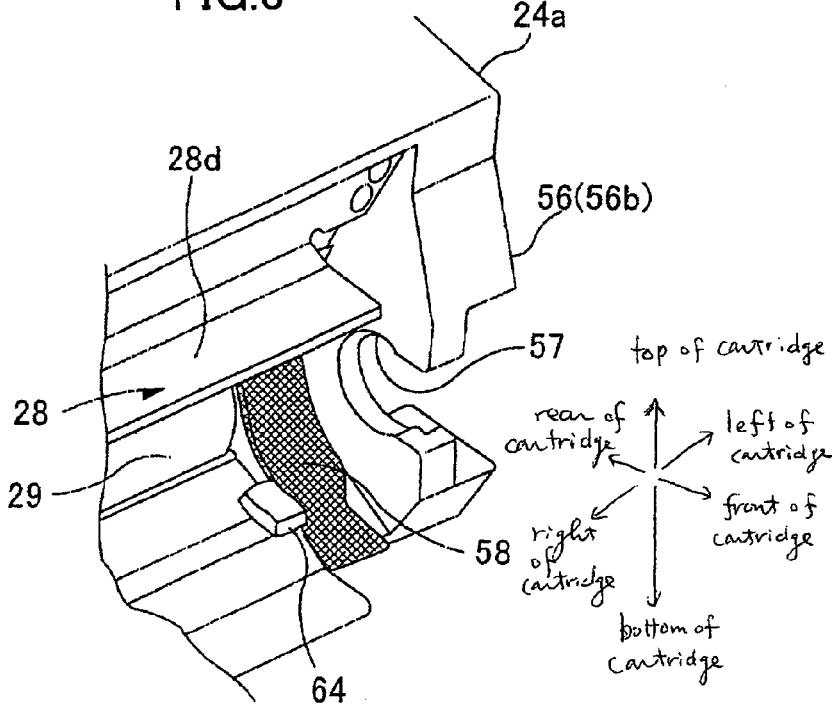
FIG. 3 is a perspective view of the developer cartridge in FIG. 2 showing the region around a side seal provided on a left-side axial end of a developing roller (while the developing roller is not mounted therein)
Figure 4A:
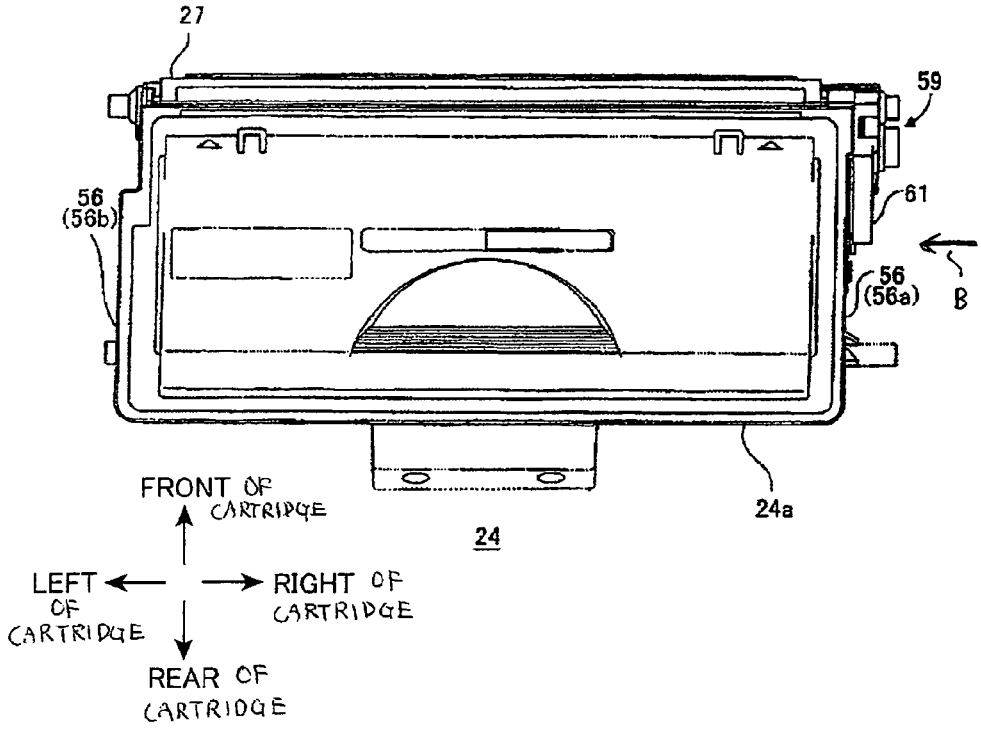
FIG. 4(*a*) is a plan view of the developer cartridge in FIG. 2.
Figure 4B:
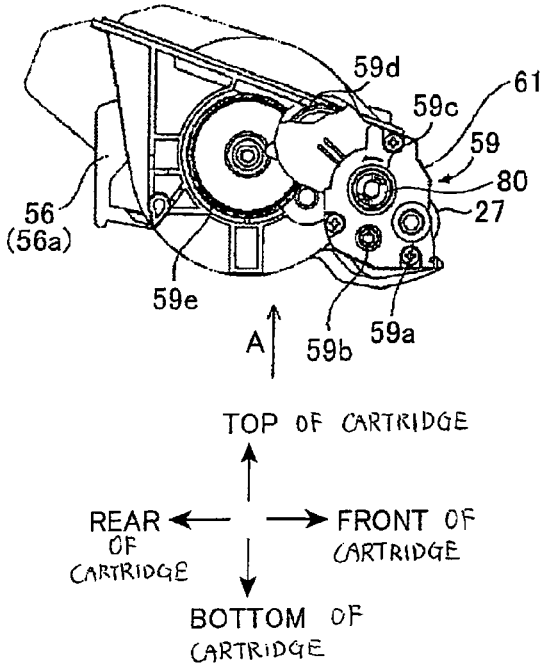
Figure 4C:
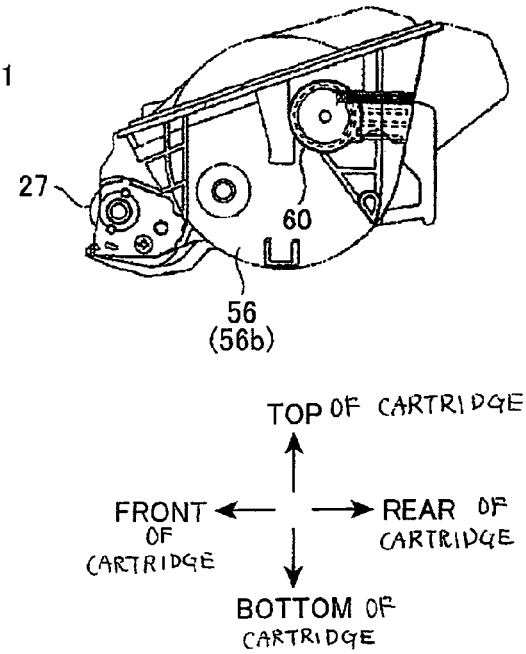
Figure 4D:
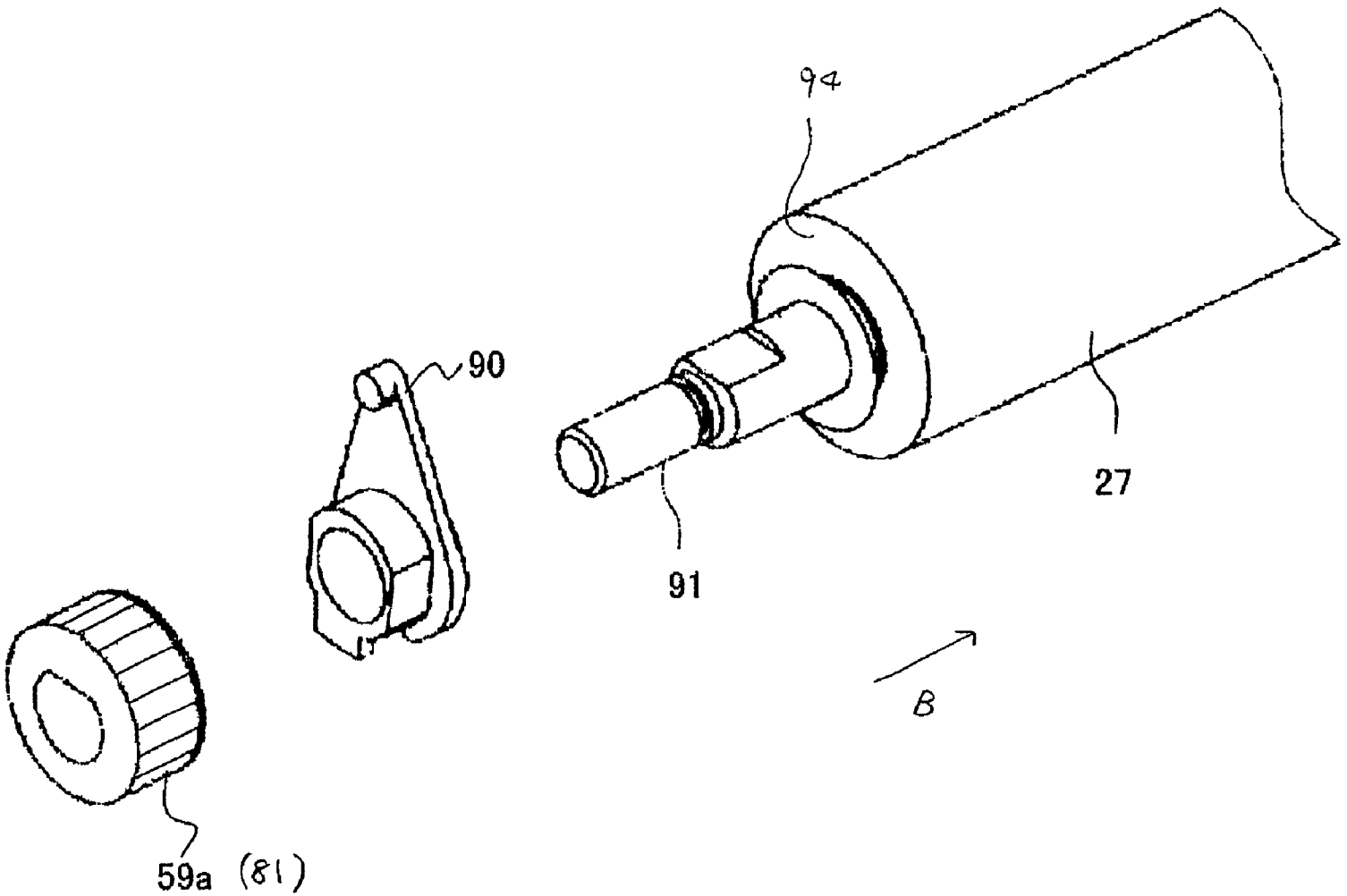
Figure 4E:
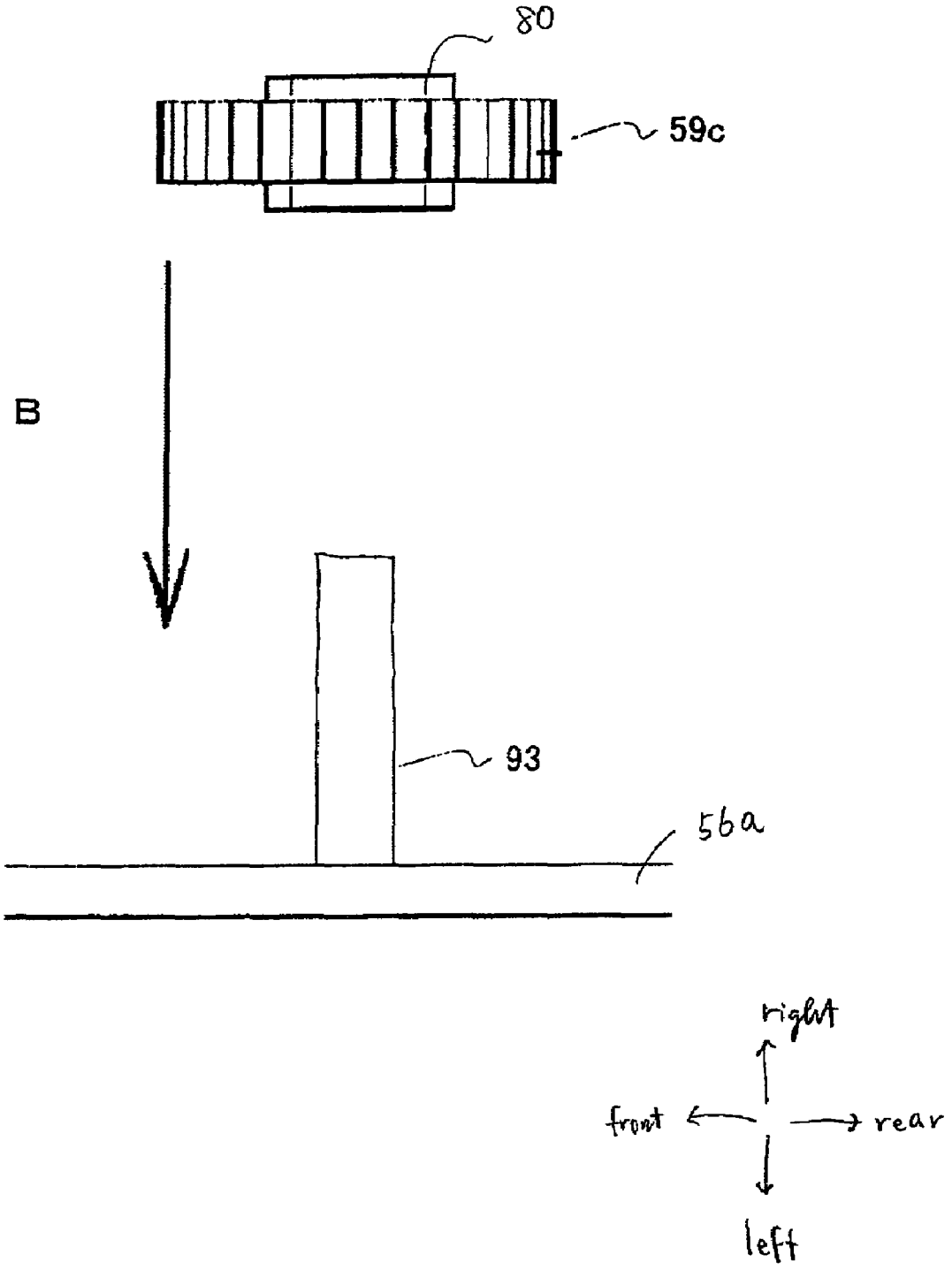

As shown in FIG. 3, an opening is formed in the casing 24*a* on the front side that the developing roller 27 is disposed. As shown in FIG. 3, a support hole 57 is formed in each of the side walls 56 for supporting the roller shaft 91 (FIG. 4(*d*)) of the developing roller 27 in the opening formed in the casing 24*a*. The support holes 57 are formed as recessed grooves that continue from the side walls 56 at the ends of the opening formed in the casing 24*a*.

A side seal 58 is fixed on the inside and adjacent to each side wall 56 for preventing toner from leaking at the axial ends of the developing roller 27. The side seal 58 is configured of a felt member fixed onto a sponge member. The axial ends of the roller portion 94 in the developing roller 27 are slidably rested on the side seals 58. A lower side seal 64 is disposed on the inner side and adjacent to each side seal 58 also for preventing leakage of toner.

While only the left side of the developer cartridge 24 is shown in FIG. 3, the construction on the right side is similar.

The roller shaft 91 is rotatably held at a pair of opposite axial ends thereof by a pair of bearings 90, only one of which is shown in FIG. 4(*d*). The bearings 90 are fixed to the side walls 56 of the developer cartridge 24. Thus, the developing roller 27 is rotatably supported on the developer cartridge 24.

As also shown in FIG. 4(*d*), a developing roller drive gear 59*a* is fixed to the right-side axial end of the roller shaft 91 so as to be incapable of rotating relative to the roller shaft 91.

Although not shown, the roller shaft of the supply roller 29 is also rotatably supported at a pair of opposite axial ends thereof on the side walls 56 of the developer cartridge 24. A supply roller drive gear 59*b* shown in FIG. 4(*b*) is fixed to the right-side axial end of the roller shaft of the supply roller 29 so as to be incapable of rotating relative to the roller shaft.

Similarly, although not shown, the rotational shaft 40*a* of the agitator 40 is also rotatably supported at a pair of opposite axial ends thereof on the side walls 56 of the developer cartridge 24. An agitator drive gear 59*e* shown in FIG. 4(*b*) is fixed to the right-side axial end of the rotational shaft 40*a* so as to be incapable of rotating relative to the rotational shaft 40*a*.

As shown in FIG. 4(*a*) and FIG. 4(*b*), the gear mechanism 59 includes the developing roller drive gear 59*a*, the supply roller drive gear 59*b*, the agitator drive gear 59*e*, an input gear 59*c*, and an intermediate gear 59*d*.

As shown in FIG. 4(*e*), an input rotational shaft 93 is integrally provided on the right-side wall 56*a* of the developer cartridge 24. The input rotational shaft 93 protrudes outwardly (rightwardly) from the right-side wall 56*a*. The input rotational shaft 93 extends parallel with the supply roller 27. The input gear 59*c* is rotatably supported on the input rotational shaft 93. A coupling 80 is integrally formed with the input gear 59*c*. The coupling 80 is coaxial with the input gear 59*c*, and is for receiving a driving force from a motor (not shown) provided in the main body of the laser printer 1.

As shown in FIG. 4(*a*) and FIG. 4(*b*), a holder plate 61 is provided on the outer surface (right-side surface) of the right-side wall 56*a*. The developing roller drive gear 59*a*, the supply roller drive gear 59*b*, the agitator drive gear 59*e*, and the input gear 59*c* with the coupling 80 are held within the holder plate 61. The right-side surface of the developing roller drive gear 59*a*, the supply roller drive gear 59*b*, the agitator drive gear 59*e*, and the input gear 59*c* with the coupling 80 can be seen through through-holes formed in the holder plate 61. The intermediate gear 59*d* is rotatably supported by the holder plate 61 and is held within the holder plate 61.

The gear mechanism 59 will be described below in more detail with reference to FIG. 5 and FIG. 6.

Figure 5:
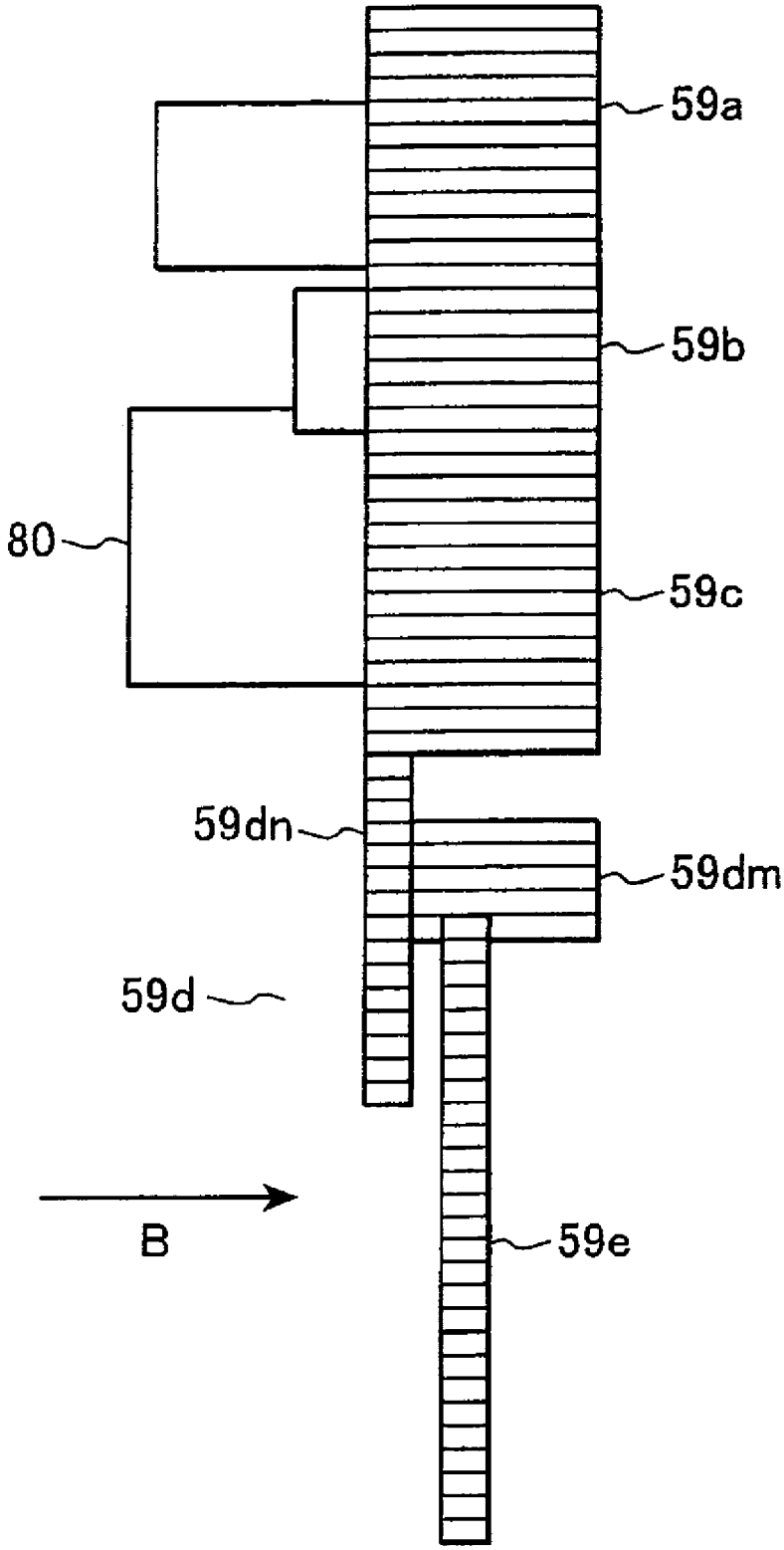
FIG. 5 illustrates a view of a gear mechanism seen along a direction A in FIG. 4(*b*) during the original use of the gear mechanism.

FIG. 5 shows the gear mechanism 59 seen along the direction A in FIG. 4(*b*) and shows how the gears in the gear mechanism 59 are engaged with one another in a plane parallel to rotational axes thereof. FIG. 6 shows the gear mechanism 59 seen along the direction B in FIG. 5 and shows how gears in the gear mechanism 59 are engaged with one another in another plane perpendicular to the rotational axes thereof.

The intermediate gear 59*d* is a two-stage gear having a large intermediate gear 59*dn* for engaging with the input gear 59*c*, and a small intermediate gear 59*dm* for engaging with the agitator drive gear 59*e*. The input gear 59*c* is engaged with the large intermediate gear 59*dn*, the developing roller drive gear 59*a*, and supply roller drive gear 59*b*.

All the gears 59*a*, 59*b*, 59*c*, 59*d*, and 59*e* are made of a resin such as a polyacetal resin or other resin that is easier to reuse, and simpler and cheaper to manufacture than a resin reinforced with glass fibers or the like. All the gears 59*a*, 59*b*, 59*c*, 59*d*, and 59*e* are spur gears, in this example.

When the developer cartridge 24 is mounted in the laser printer 1, the motor (not shown) provided in the laser printer 1 inputs a driving force to the input gear 59*c* via the coupling 80 of the input gear 59*c*. At this time, the inputted driving force is transferred to the developing roller drive gear 59*a* and supply roller drive gear 59*b* and drives the developing roller 27 and supply roller 29 to rotate. Further, the driving force is transferred via the intermediate gear 59*d* to the agitator drive gear 59*e* and drives the agitator 40 to rotate.

The toner cap 60 can be opened or closed over an opening formed in the left-side wall 56*b*. In a refilling process described later, the toner cap 60 is removed to discharge toner that remains in the filling chamber 26*a* after the initial use of the developer cartridge 24 and to refill the filling chamber 26*a* with a refill toner.

As shown in FIG. 2, the agitator 40 rotates in the counterclockwise direction in the drawing, as indicated by the arrow, agitating toner in the filling chamber 26*a* and conveying some of the toner through the toner supply opening 39 into the developing chamber 26*b*. An optical sensor (not shown) emits light that passes through the windows 62 formed in the side walls 56 of the filling chamber 26*a*. The cleaner 63 supported on the agitator 40 cleans the windows 62. The windows 62 function for detecting the amount of toner remaining in the filling chamber 26*a*. When the filling chamber 26*a* is filled with toner, the light from the optical sensor cannot pass through the windows 62. However, as the amount of toner remaining in the filling chamber 26*a* decreases, the light from the optical sensor passes through the windows 62, at which time the laser printer 1 displays an out-of-toner message in a control panel (not shown) provided on the main casing 2.

Next, toner conveyed through the toner supply opening 39 into the developing chamber 26*b* is supplied onto the developing roller 27 by the rotation of the supply roller 29. At this time, the toner is positively tribocharged between the supply roller 29 and the developing roller 27. As the developing roller 27 continues to rotate, the toner supplied onto the surface of the developing roller 27 passes between the pressing part 28*b* of the thickness-regulating blade 28 and the developing roller 27, enabling a thin layer of uniform thickness to be carried reliably on the developing roller 27.

As shown in FIG. 1, the photosensitive drum 23 is disposed to the side of the developing roller 27 and is capable of rotating counterclockwise in FIG. 1, as indicated by the arrow in the drawing, while in confrontation with the developing roller 27. The photosensitive drum 23 includes a main drum body that is grounded, and a surface layer formed of a photosensitive layer of polycarbonate or the like with a positive charging nature.

The charger 37 is disposed above the photosensitive drum 23 and is separated a prescribed distance therefrom so as not to contact the photosensitive drum 23. The charger 37 is a positive charging Scorotron charger having a charging wire formed of tungsten or the like from which a corona discharge is generated. The charger 37 functions to charge the entire surface of the photosensitive drum 23 with a uniform positive polarity.

As the photosensitive drum 23 rotates, the charger 37 charges the surface of the photosensitive drum 23 with a uniform positive polarity. Subsequently, the scanning unit 17 irradiates a laser beam in a high-speed scan to form an electrostatic latent image on the surface of the photosensitive drum 23 based on prescribed image data.

Next, positively charged toner carried on the surface of the developing roller 27 comes into contact with the photosensitive drum 23 as the developing roller 27 rotates and is supplied to areas on the surface of the positively charged photosensitive drum 23 that have been exposed to the laser beam and, therefore, have a lower potential. In this way, the latent image on the photosensitive drum 23 is developed into a visible image according to a reverse development process.

The transfer roller 25 is rotatably supported in the drum cartridge 38 at a position below the photosensitive drum 23 and rotates while confronting the photosensitive drum 23. The transfer roller 25 is configured of a metal roller shaft covered by a roller that is formed of an electrically conductive rubber material. A prescribed transfer bias relative to the photosensitive drum 23 is applied to the transfer roller 25 during a transfer operation. As a consequence, the visible image carried on the surface of the photosensitive drum 23 is transferred onto the paper 3, as the paper 3 passes between the photosensitive drum 23 and transfer roller 25. A conveying belt 30 is disposed downstream of the photosensitive drum 23 and transfer roller 25 for conveying the paper 3 to the fixing unit 19 after a visible image has been transferred onto the paper 3.

The fixing unit 19 is disposed downstream of the process unit 18 and includes a heating roller 31, a pressure roller 32 that contacts the heating roller 31 with pressure, and a pair of conveying rollers 33 disposed downstream of the heating roller 31 and pressure roller 32.

The heating roller 31 is formed of a metal and accommodates a halogen lamp for generating heat. After toner has been transferred onto the paper 3 in the process unit 18, the toner image is fixed to the paper 3 by heat as the paper 3 passes between the heating roller 31 and pressure roller 32. Subsequently, the conveying rollers 33 convey the paper 3 sequentially to conveying rollers 34 and discharge rollers 35 provided in the main casing 2 downstream in the conveying direction. The discharge rollers 35 receive the paper 3 conveyed by the conveying rollers 34 and discharge the paper 3 onto a discharge tray 36.

Further, the laser printer 1 employs a cleanerless developing method for recovering residual toner. Specifically, after the transfer roller 25 transfers toner onto the paper 3, the developing roller 27 recovers any toner remaining on the surface of the photosensitive drum 23. Using this type of cleanerless developing method to recover residual toner eliminates the need for a blade or other special member to remove the residual toner, and a collector for collecting the waste toner, thereby simplifying the structure of the device.

The laser printer 1 also includes a reconveying unit 41 for performing duplex printing. The reconveying unit 41 is integrally configured of a reversing mechanism 42 and a reconveying tray 43 that are detachably mounted in the rear side of the main casing 2. The reversing mechanism 42 is mounted externally on the main casing 2, while the reconveying tray 43 is inserted above the feeding unit 4.

The reversing mechanism 42 mounted externally on the rear wall of the main casing 2 includes a casing 44 having a substantially rectangular cross section and, within the casing 44, a pair of reversing rollers 46, and a pair of reconveying rollers 47. The reversing mechanism 42 also includes a reverse guide plate 48 that protrudes upward from the upper end of the casing 44.

A flapper 45 is disposed downstream from the conveying rollers 33 for selectively switching the direction in which the conveying rollers 33 conveys the paper 3 after an image has been formed on one side of the paper 3 between a direction toward the conveying rollers 34 (indicated by a solid line) and a direction toward the reversing rollers 46 (indicated by a dotted line) described later. The flapper 45 is rotatably supported in the rear section of the main casing 2 and is disposed downstream of and near the conveying rollers 33. By toggling the excitation of a solenoid (not shown) on and off, the flapper 45 can be pivoted to selectively switch the conveying direction for the paper 3 described above.

The pair of reversing rollers 46 are disposed in the top section of the casing 44 downstream of the flapper 45. The reversing rollers 46 can be switched between forward and reverse rotational directions. First, the reversing rollers 46 are rotated in the forward direction for conveying the paper 3 toward the reverse guide plate 48. Subsequently, the reversing rollers 46 are rotated in the reverse direction to convey the paper 3 in the opposite direction.

The pair of reconveying rollers 47 is disposed in the casing 44 at a position almost directly below the reversing rollers 46 and downstream thereof. The reconveying rollers 47 convey the paper 3 into the reconveying tray 43 after the paper 3 has been reversed by the reversing rollers 46.

The reverse guide plate 48 is configured of a plate-shaped member extending upward from the top end of the casing 44 for guiding the paper 3 that is conveyed by the reversing rollers 46.

When forming images on both sides of the paper 3, the reversing mechanism 42 functions as follows. First, the flapper 45 switches the conveying direction of the paper 3 toward the reversing rollers 46. Hence, after an image is formed on one surface of the paper 3, the paper 3 is received in the reversing mechanism 42 and is conveyed to the reversing rollers 46. At this time, the reversing rollers 46 rotate in a forward rotation with the paper 3 interposed therebetween, conveying the paper 3 temporarily outward in an upward direction along the reverse guide plate 48 so that a large part of the paper 3 is conveyed out of the device. When the trailing edge of the paper 3 becomes interposed between the reversing rollers 46, the forward rotation is halted. Next, the reversing rollers 46 are rotated in the reverse direction, conveying the paper 3 almost directly downward toward the reconveying rollers 47 so that the trailing edge becomes the leading edge. A paper sensor 156 is disposed downstream of the fixing unit 19 for detecting the trailing edge of the paper 3. The reversing rollers 46 is controlled to switch from a forward rotation to the reverse rotation a prescribed time after the paper sensor 156 detects the trailing edge of the paper 3. Further, after the paper 3 has been conveyed to the reversing rollers 46, the flapper 45 is switched back to its original state for conveying the paper 3 from the conveying rollers 33 to the conveying rollers 34.

When the reversing rollers 46 convey the paper 3 in reverse toward the reconveying rollers 47, the reconveying rollers 47 receive the paper 3 and convey the paper 3 into the reconveying tray 43 described next.

The reconveying tray 43 includes a paper supplying unit 49 for supplying the paper 3, a main tray member 50, and skewed rollers 51.

The paper supplying unit 49 is mounted externally on the rear of the main casing 2 below the reversing mechanism 42 and includes a curved guide member 52. As the reconveying rollers 47 convey the paper 3 almost vertically downward from the reversing mechanism 42 into the paper supplying unit 49, the guide member 52 guides the paper 3 into a substantially horizontal direction so as to convey the paper 3 substantially horizontally onto the main tray member 50.

The main tray member 50 has a substantially rectangular plate shape and is disposed substantially along a horizontal plane above the paper tray 6. The upstream end of the main tray member 50 is coupled with the guide member 52, while the downstream end is coupled with the upstream end of a reconveying path 53. The downstream end of the reconveying path 53 is connected to the middle of the paper conveying path 65 in order to guide the paper 3 from the main tray member 50 to the second conveying rollers 10.

Two of the skewed rollers 51 are provided at a prescribed interval along the path that the paper 3 is conveyed over the main tray member 50 for conveying the paper 3 so that a side of the paper 3 remains in contact with a reference plate (not shown).

Each skewed roller 51 includes a skewed drive roller 54 and a skewed follow roller 55. The skewed drive roller 54 is disposed near the reference plate, which is provided along a widthwise edge of the main tray member 50. The axis of the skewed drive roller 54 extends in a direction substantially orthogonal to the conveying direction of the paper 3. Each skewed follow roller 55 is disposed in opposition to the corresponding skewed drive roller 54 so that the paper 3 is interposed therebetween. The axis of the skewed follow roller 55 is slanted from the direction substantially orthogonal to the conveying direction of the paper 3 so as to shift the paper 3 toward the surface of the reference plate while conveying the paper 3 downstream.

As the paper 3 is conveyed from the paper supplying unit 49 onto the main tray member 50, the skewed rollers 51 convey the paper 3 with a widthwise edge of the paper 3 in contact with the reference plate. The skewed rollers 51 convey the paper 3 along the reconveying path 53 toward the image-forming position with the top and bottom surfaces reversed. Hence, when the paper 3 is conveyed to the image-forming position the second time, the bottom surface opposes and contacts the photosensitive drum 23. After a visible image is transferred onto this surface, the image is fixed on the paper 3 in the fixing unit 19, and the paper 3, now having images formed on both surfaces thereof, is discharged onto the discharge tray 36.

After the toner in the filling chamber **26*a* is used up through repeated image-forming operations, the used developer cartridge 24 provided in this type of laser printer 1 is not simply discarded, but can be reused by refilling the developer cartridge 24** with toner and replacing the gears.

Next, a method of reusing or recycling the developer cartridge 24 having the construction described above will be described. During the first use of the developer cartridge 24, the filling chamber **26*a* of the developer cartridge 24** is filled with a suspension polymerized toner.

When the suspension polymerized toner in the developer cartridge 24 is consumed and an out-of-toner message is displayed, the user replaces the developer cartridge 24 with a new cartridge.

The used developer cartridge 24 removed from the laser printer 1 is recovered by a manufacturer of the developer cartridge 24. The manufacturer refills this developer cartridge 24 with toner having less fluidity than the suspension polymerized toner used previously and having a higher fluidity than crushed toner that has not undergone spherical processing.

Specifically, when refilling the developer cartridge 24 according to this method, the same type of suspension polymerized toner used previously is not used. Instead, it is possible to use a suspension polymerized toner containing less additive than that contained in the previously used toner. Alternatively, the developer cartridge 24 may be refilled with an emulsion polymerized toner or a crushed toner that has undergone spherical processing.

Using a toner with less fluidity in this way can prevent toner from leaking from the side seals 58 at the axial ends of the roller portion 94 of the developing roller 27 due to wear of the side seals 58.

Figure 7:
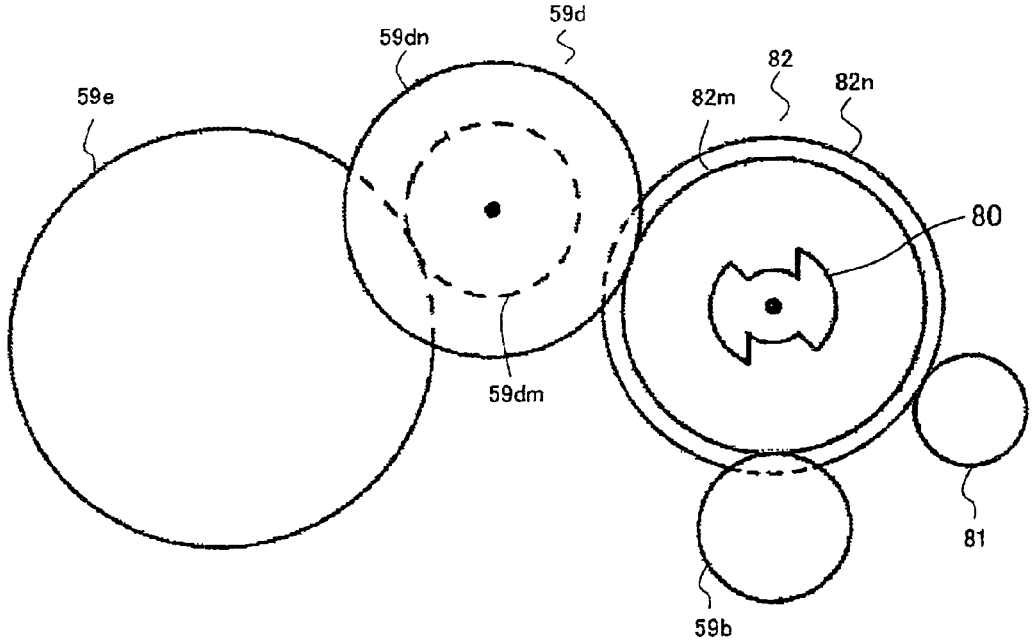
FIG. 7 is a view of a gear mechanism seen along the direction B after replacement of gears.
Figure 8A:
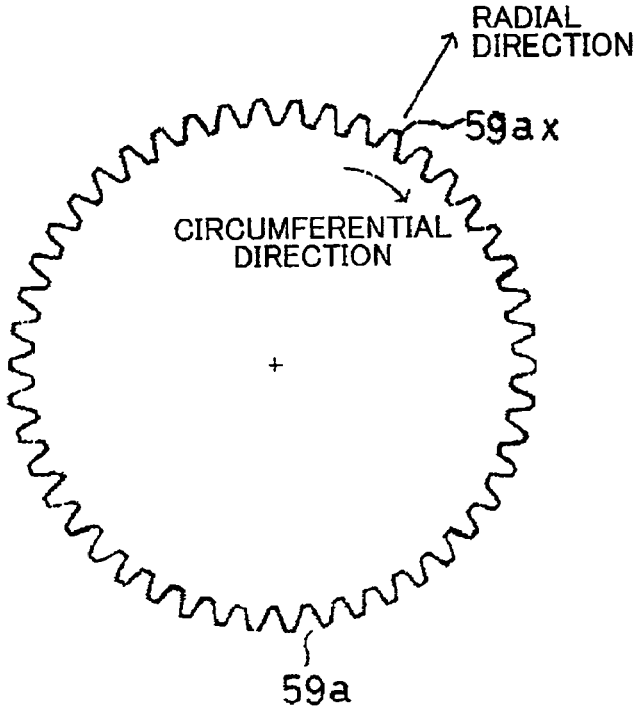
FIG. 8(*a*) is a view of the developing roller drive gear seen along the direction B during the original use of the gear mechanism.
Figure 8B:
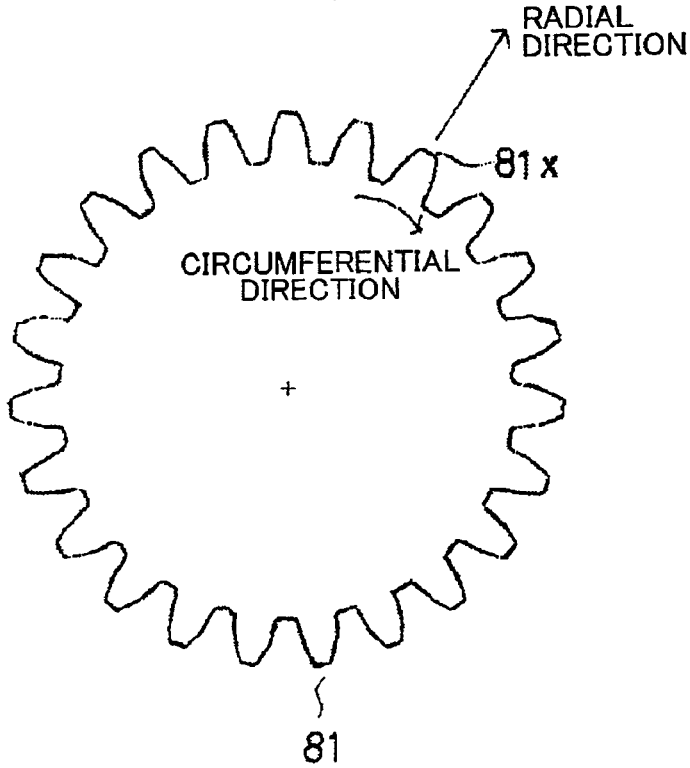
Figure 8C:
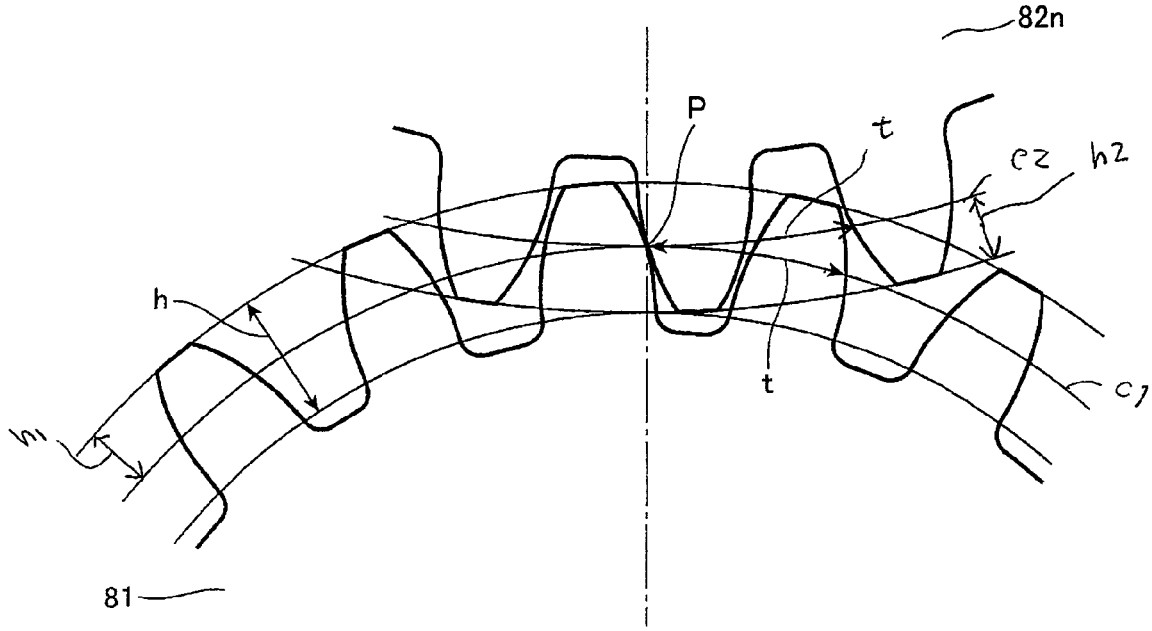
Figure 8D:
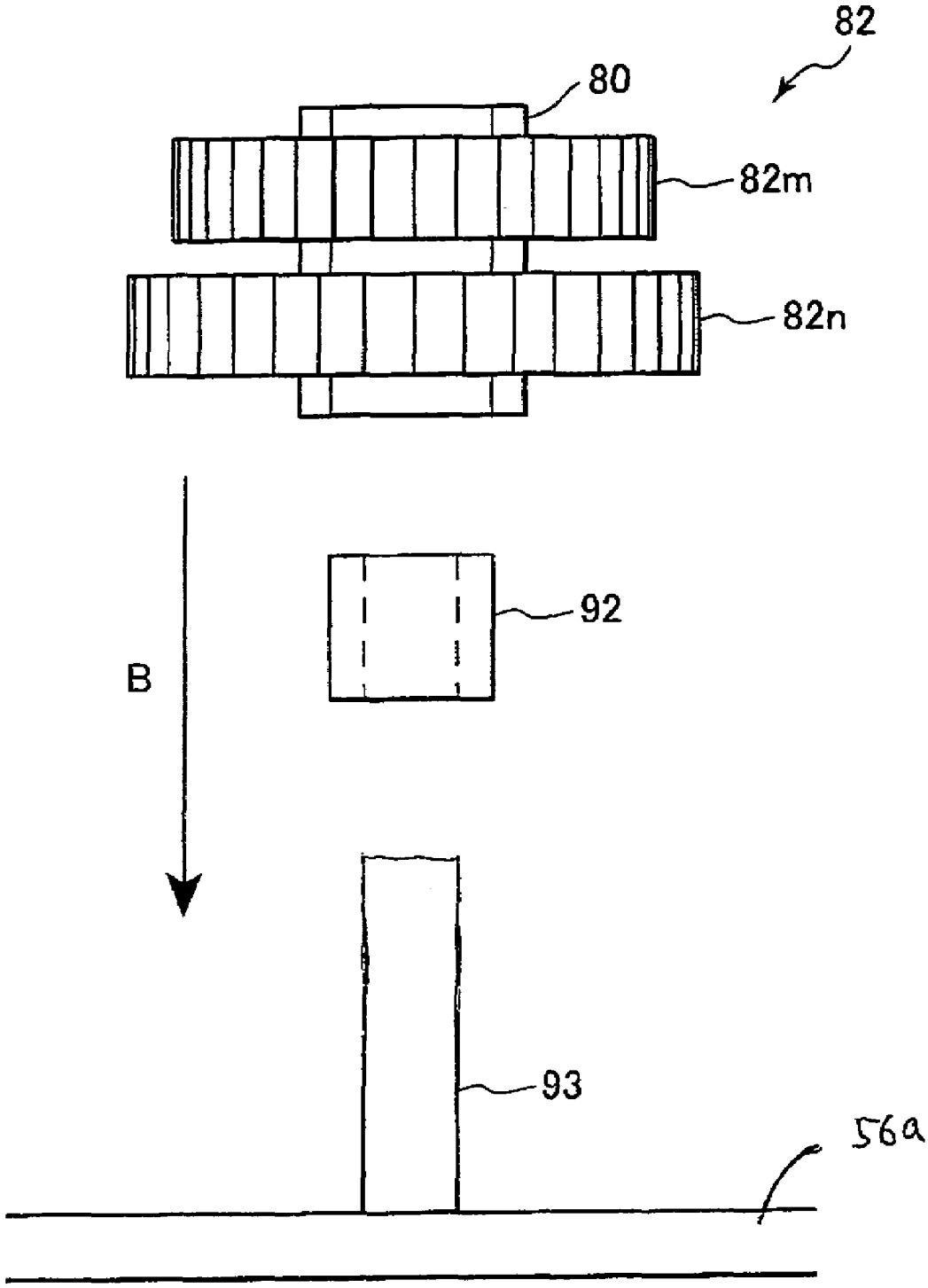

After the casing 24*a* has been refilled with toner, as illustrated in FIG. 7, the developing roller drive gear 59*a* is replaced with a replacement developing roller drive gear 81 having a larger module than the original developing roller drive gear 59*a*. The input gear 59*c* is then replaced with a replacement two-stage input gear 82 configured of a first input gear 82*n* for engaging with the developing roller drive gear 81, and a second input gear 82*m* for engaging with the supply roller drive gear 59*b* and intermediate gear 59*d*. The first input gear 82*n* has a larger module than the original input gear 59*c*, while the second input gear 82*m* has a module identical to that of the original input gear 59*c*.

As with the original gears, the developing roller drive gear 81 and input gear 82 are also formed of a polyacetal resin or other resin that is easier to reuse and simpler and more cost-effective to manufacture than a resin that is reinforced with glass fibers.

FIG. 8(*a*) is a plan view of the original developing roller drive gear 59*a* on a plane perpendicular to its rotational axis. The original developing roller drive gear 59*a* has gear teeth 59*ax*. FIG. 8(*b*) is a view of the replacement developing roller drive gear 81 on a plane perpendicular to its rotational axis. The replacement developing roller drive gear 81 has gear teeth 81*x*. As apparent from FIG. 8(*a*) and FIG. 8(*b*), the gear teeth 81*x* are larger than the gear teeth 59*ax* both in the radial direction and in the circumferential direction (rotational direction).

FIG. 8(*c*) shows how the gears 81 and 82*n* are engaged with each other. Gear teeth of the gears 81 and 82*n* are involute teeth. Pitch circles $C_1$ and $C_2$ for the gears 81 and 82*n*, respectively, pass through the point P where the teeth of the gears 81 and 82*n* touch with each other. The gears 81 and 82*n* have a module m ($=d_1/z_1=d_2/z_2$), wherein $d_1$ is the diameter of the pitch circle $C_1$, $z_1$ is the total number of teeth formed on the gear 81, $d_2$ is the diameter of the pitch circle $C_2$ and $z_2$ is the total number of teeth formed on the gear 82*n*. The circular pitch t for the gears 81 and 82*n* is equal to $\pi$m. The working depth h for the gears 81 and 82*n* is the depth of engagement of the gears 81 and 82*n*, that is, the sum of the addendum $h_1$ of the gear 81 and the addendum $h_2$ of the gear 82*n*. The addendum h1 is the height by which a tooth of the gear 81 projects beyond the pitch circle $C_1$ for the gear 81. The addendum $h_2$ is the height by which a tooth of the gear 82*n* projects beyond the pitch circle $C_2$ for the gear 81. The working depth h is equal to 2*m*.

Because the module m of the replacement gears 81 and 82*n* is greater than that of the original gears 59*a* and 59*c*, the working depth h of the replacement gears 81 and 82*n* is also greater than that of the original gears 59*a* and 59*c*.

By replacing the original gears 59*a* and 59*c* with the replacement gears 81 and 82*n* having larger modules, the engagement of gear teeth between the replacement gears 81 and 82*n* is deeper in the radial direction of the gears than the engagement of gear teeth between the original gears 59*a* and 59*c* to prevent slippage. Further, the thickness of the teeth in the replacement gears 81 and 82*n* in the rotational direction of the gears is greater than that in the original gears 59*a* and 59*c*, thereby reinforcing the gear teeth in the rotational direction and further preventing gear slippage.

It is noted that because the developer cartridge 24 is refilled with toner having less fluidity, during the reuse of the developer cartridge 24, it can be estimated that the toner having less fluidity will offer greater resistance to the agitator 40, developing roller 27, supply roller 29, and the like. Accordingly, the torque applied to the gears in the gear mechanism 59 in the subsequent reuse will become larger than that during the initial use. Consequently, there will be a danger of the gears slipping.

Considering the above-described possible problem, when the developer cartridge 24 is refilled with toner having less fluidity, the set of original gears 59*a* and 59*c* is replaced with the set of replacement gears 81 and 82*n* having a larger module. The gear teeth in the replacement gears 81 and 82*n* have a larger working depth than those in the original gears 59*a* and 59*c*, thereby increasing the thickness of the gears in the rotational direction and reinforcing the gear teeth in the rotational direction. It is possible to prevent gear slippage.

It is also estimated that of all the gears in the gear mechanism 59, the developing roller drive gear 59*a* will incur a particularly large increase in torque when reusing the developer cartridge 24. That is, the toner passing between the developing roller 27 and supply roller 29 will increase the force opposing the rotations of the developing roller 27 and supply roller 29, and the toner passing between the developing roller 27 and thickness-regulating blade 28 will increase the force opposing the rotation of the developing roller 27.

Thus, the developing roller drive gear 59*a* is estimated to receive the greatest increase in torque when the developer cartridge 24 is reused. Therefore, by replacing only the developing roller drive gear 59*a* and the input gear 59*c* that engages with the developing roller drive gear 59*a*, it is possible to prevent gear slippage effectively while replacing few gears.

Further, when manufacturing a new developer cartridge 24 that has never been reused, it is unnecessary to use gears formed of resin reinforced with glass fibers or the like that are burdensome to the environment, require complex processing steps, and are more costly to manufacture.

In the above description, the teeth in the original gears 59*a* and 59*c* have involute profiles, and the teeth in the replacement gears 81 and 82*n* have also involute profiles. Accordingly, modules can be defined for the original gears 59*a* and 59*c* and for the replacement gears 81 and 82*n*. However, the teeth of the original gears 59*a* and 59*c* and the replacement gears 81 and 82*n* may not have involute profiles. In this case, the replacement gear 81 is designed to have at least a part of each tooth wider in the rotational direction than each tooth in the original gear 59*a*, and the replacement gear 82*n* is designed to have at least a part of each tooth wider in the rotational direction than each tooth in the original gear 59*c*.

For example, the replacement gear 81 is designed to have at least a base part of each tooth wider in the rotational direction than each tooth in the original gear 59*a*, and the replacement gear 82*n* is designed to have at least a base part of each tooth wider in the rotational direction than each tooth in the original gear 59*c*. Because the replacement gears 81 and 82*n* have the above-described configuration, it is possible to prevent gear slipping even if a larger torque is applied to the replacement gears 81 and 82*n* during reuse than during the original use.

The replacement developing roller drive gear 81 and input gear 82 are formed of the material which is easy to reuse, similarly to the original gears. Accordingly, when reusing the developer cartridge 24, it is possible to reduce the burden on the environment more than when using glass fiber reinforced resin.

After refilling the developer cartridge 24 with toner, at the same time the gears 59*a* and 59*c* are replaced with the replacement gears 81 and 82, the pair of bearings 90 that support the rotational shaft 91 of the developing roller 27 may be replaced with a pair of new bearings 90 that have never been used for the developer cartridge 24.

During the original use of the developer cartridge 24, as the roller shaft 91 slides within the bearings 90, both components wear and produce fine shavings. After extended use, the shavings accumulate between the bearings 90 and roller shaft 91, increasing the force opposing the rotation of the developing roller 27. As the wear progresses further, the rotation of the roller shaft 91 may become irregular and further increase the force opposing the rotation of the developing roller 27. As a result, the torque applied to the developing roller drive gear 59*a* gradually increases.

When refilling the developer cartridge 24 with toner, by replacing the bearings 90 with the new bearings 90 in addition to replacing the gears 59*a* and 59*c* with the replacement gears 81 and 82, it is possible to prevent a greater torque from being applied to the developing roller drive gear 81 due to increased wear of the bearings 90 during reuse of the developer cartridge 24.

Both of the pair of bearings 90 may not be replaced with new bearings 90. Only one of the bearings 90 may be replaced with a new bearing 90.

Similarly, after refilling the developer cartridge 24 with toner and replacing the gears 59*a* and 59*c* with the replacement gears 81 and 82, as shown in FIG. 8(*d*), a thin, cylindrical sliding member 92 may be inserted between the input rotational shaft 93 and the surface of the replacement input gear 82 opposing the surface of the input rotational shaft 93. The sliding member 92 is preferably formed of polyacetal resin or another resin having good slidability.

During the original use of the developer cartridge 24, the opposing surfaces of the input rotational shaft 93 and the original input gear 59*c* slide over each other as shown in FIG. 4(*e*), and cause wear. When this wear progresses, the rotation of the input gear 59*c* becomes uneven, which unevenness increases the torque applied to the input gear 59*c*.

When refilling the developer cartridge 24 with toner and replacing the original input gear 59*c* with the replacement input gear 82, by interposing the thin, cylindrical sliding member 92 between the replacement input gear 82 and the input rotational shaft 93, it is possible to prevent an increase in torque from being applied to the replacement input gear 82 due to increased wear of the input rotational shaft 93.

Figure 9A:
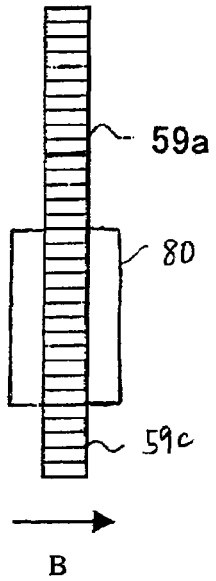
FIG. 9(*a*) is an explanatory diagram showing the axial thickness of the developing roller drive gear during the original use of the gear mechanism.
Figure 9B:
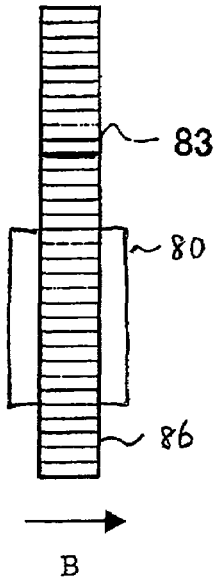

Instead of replacing the set of original gears 59*a* and 59*c* with the set of replacement gears 81 and 82 described above, the set of original gears 59*a* and 59*c* may be replaced with another set of replacement gears 83 and 86 shown in FIG. 9(*b*). Similarly to the replacement gears 81 and 82, the replacement gears 83 and 86 are manufactured of a polyacetal resin or other resin similar to the original gears 59*a* and 59*c*.

FIG. 9(*a*) is a side view of the original developing roller drive gear 59*a* and original input gear 59*c* viewed in the direction A of FIG. 4(*b*). That is, FIG. 9(*a*) shows how the original developing roller drive gear 59*a* and original input gear 59*c* are engaged with each other in a plane parallel to the rotational axes of the gears 59*a* and 59*c*.

FIG. 9(*b*) is a side view of the replacement developing roller drive gear 83 and replacement input gear 86 viewed in the direction A of FIG. 4(*b*). That is, FIG. 9(*b*) shows how the replacement developing roller drive gear 83 and replacement input gear 86 are engaged with each other in the plane parallel to the rotational axes of the gears 83 and 86.

The replacement developing roller drive gear 83 has a greater width in the axial direction (direction B), that is, a greater tooth width than the original developing roller drive gear 59*a*. Similarly, the replacement input gear 86 has a greater axial width along the direction B, that is, a greater tooth width than the original input gear 59*c*.

FIGS. 9(*a*) and 9(*b*) compare the thickness of the original gears 59*a* and 59*c* to that of the replacement gears 83 and 86 in the axial direction (direction B). As can be seen in the drawings, the replacement gears 83 and 86 in the direction B are thicker than the original gears 59*a* and 59*c* in the direction B.

Increasing the thickness of the gears in the axial direction (direction B) improves the gear strength in the rotational direction and prevents gear slippage.

Further, the replacement input gear 86 is simply thicker in the axial direction than the original input gear 59*c* and need not be a two-stage gear. Hence, the manufacturing of the replacement input gear 86 is not particularly more difficult than manufacturing the original input gear 59*c*.

Figure 6:
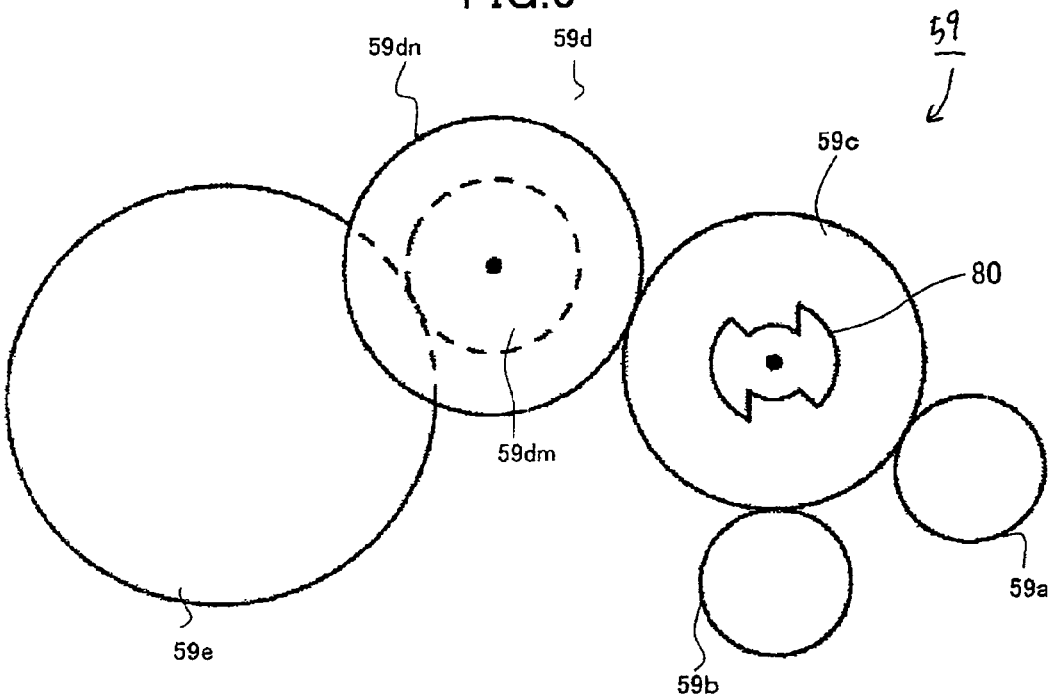
FIG. 6 is a view of the gear mechanism seen along a direction B in FIG. 5 during the original use of the gear mechanism.
Figure 10:
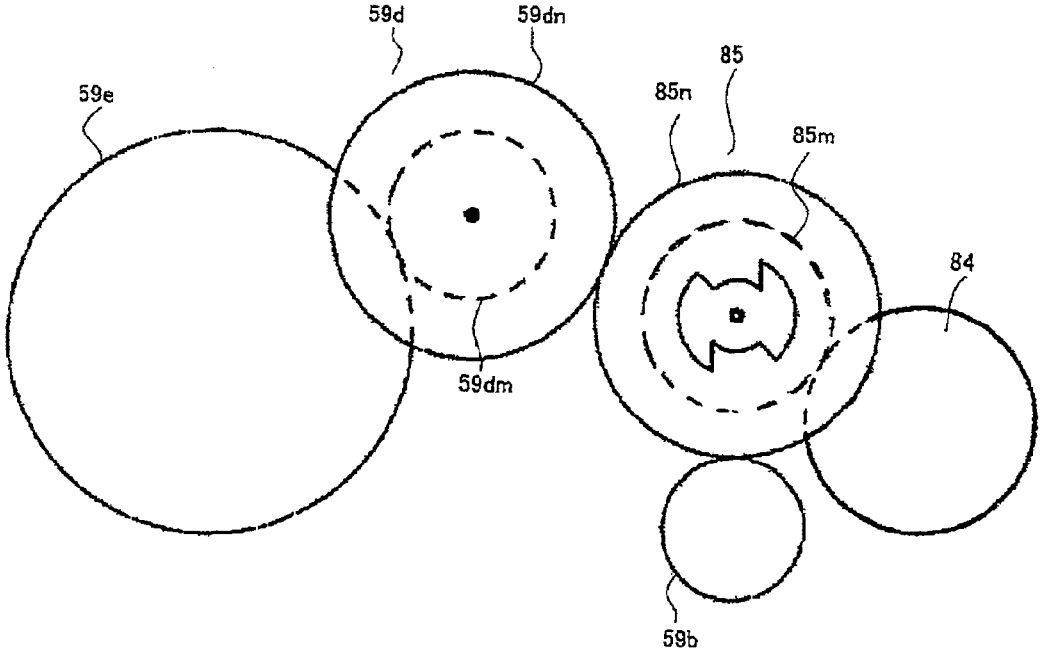
FIG. 10 is a view of a gear mechanism seen along the direction B after replacement of gears according to another additional aspect.

Instead of replacing the set of original gears 59*a* and 59*c* shown in FIG. 6 with the set of replacement gears 81 and 82 shown in FIG. 7, the set of original gears 59*a* and 59*c* may be replaced with still another set of replacement gears 84 and 85 (replacement developing roller drive gear 84 and replacement input gear 85) shown in FIG. 10. Similarly to the replacement gears 81 and 82, the replacement gears 84 and 85 are manufactured of a polyacetal resin or other resin similar to the original gears 59*a* and 59*c*.

The replacement input gear 85 is configured of a two-stage gear having a first input gear 85*m* that engages with the developing roller drive gear 84, and a second input gear 85*n* that engages with the supply roller drive gear 59*b* and the intermediate gear 59*d*.

The gear ratio of the replacement developing roller drive gear 84 to the replacement first input gear 85*m* is greater than the gear ratio of the original developing roller drive gear 59*a* to the original input gear 59*c* shown in FIG. 6. In other words, the ratio of the number of gear teeth of the gear 84 relative to the number of gear teeth of the gear 85*m* is greater than the ratio of the number of gear teeth of the gear 59*a* relative to the number of gear teeth of the gear 59*c*.

Accordingly, the peripheral velocity of the replacement developing roller drive gear 84 becomes less than that of the original developing roller drive gear 59*a*. Hence, the torque applied to the replacement developing roller drive gear 84 becomes less than the torque applied to the original developing roller drive gear 59*a*, thereby preventing gear slippage when the developer cartridge 24 is reused.

While the invention has been described in detail with reference to the above aspects thereof, it would be apparent to those skilled in the art that various changes and modifications may be made therein without departing from the spirit of the invention.

For example, in the above description, the gears 59*a* and 59*c* are replaced with replacement gears 81 and 82 having a larger module, replacement gears 83 and 86 having a larger axial thickness, or replacement gears 84 and 85 causing a slower peripheral speed for the gear 84. Instead, the original gears 59*a* and 59*c* may be replaced with other replacement gears that have the same shapes and the same sizes with the original gears 59*a* and 59*c* but that are formed of a glass fiber reinforced resin or the like instead.

Use of this reinforced resin increases the strength of the gears in their rotational directions, thereby preventing gear slippage.

When manufacturing a new developer cartridge 24 that has never been reused, it is still unnecessary to form the gears 59*a* and 59*c* of resin reinforced with glass fibers or the like that are burdensome to the environment, require complex processing steps, and are more costly to manufacture.

In this case, it is also possible to replace the gears independently. That is, only the developing roller drive gear 59*a* may be replaced with a glass fiber reinforced resin gear. The input gear 59*c* may not be replaced with a glass fiber reinforced resin gear, but may simply be replaced with a new input gear 59*c* that has never been used for the developer cartridge 24.

Further, while only the developing roller drive gear 59*a* and input gear 59*c* are targeted as replacement gears in the above description, the other gears may be replaced as well.

For example, the agitator drive gear 59*e* and intermediate gear 59*d* may also be replaced.

More specifically, the agitator drive gear 59*e* may be replaced with an agitator drive gear having a larger module. The intermediate gear 59*d* may be replaced with an intermediate gear configured of a small intermediate gear having a large module for engaging with the replacement agitator drive gear, and a large intermediate gear having the same module of the original large intermediate gear 59*dn*.

This construction can prevent gear slippage between the agitator drive gear and the intermediate engaged therewith, even though the torque applied to the agitator drive gear is increased after refilling the developer cartridge 24 with toner having less fluidity.

All the gears in the gear mechanism 59 may be replaced with replacement gears having a larger module.

Similarly, any desirable one or more sets of gears that are engaged with one another may be replaced with one or more sets of replacement gears having at least a part of each tooth having a larger width in the rotational direction.

Similarly, any desirable one or more sets of gears that are engaged with one another may be replaced with one or more sets of replacement gears having a larger axial thickness.

Similarly, any desirable one or more sets of gears that are engaged with one another may be replaced with one or more sets of replacement gears that will cause some desirable gears to rotate with a slower peripheral speed.

Similarly, any desirable one or more gears may be replaced with one or more replacement gears formed of glass fiber reinforced resin or the like. In this case, it is possible to replace those any desirable one or more gears independently from other gears.

Figure 11:
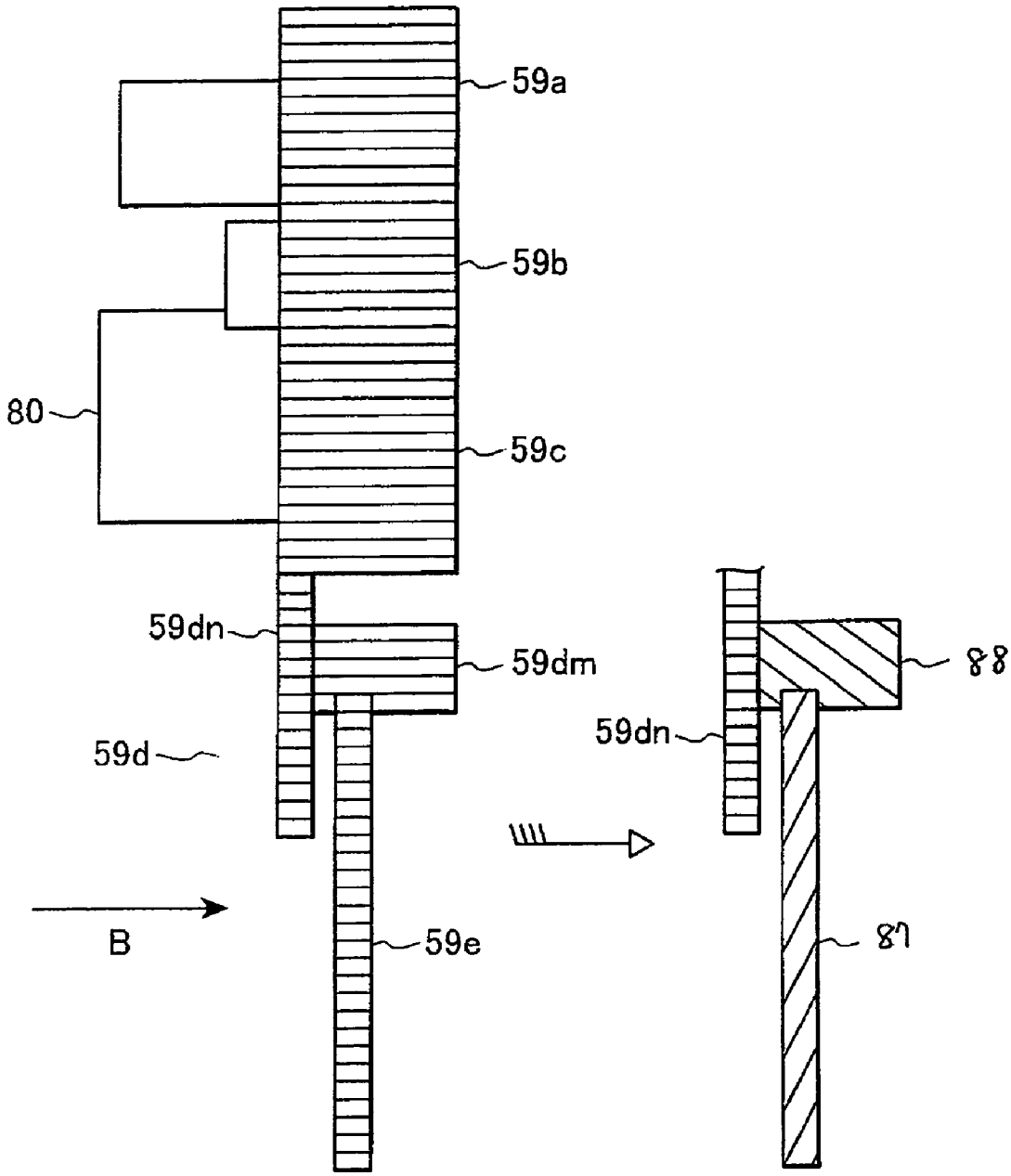
FIG. 11 shows how to replace an agitator drive gear and a small intermediate gear of spur gears with helical gears according to another additional aspect.

In the above description, all the gears in the gear mechanism 59 are spur gears. Accordingly, one or more desirable sets of gears that are engaged with one another may be replaced with helical gears. For example, as shown in FIG. 11, the agitator drive gear 59*e* and small intermediate gear 59*dm* may be replaced with helical gears 87 and 88.

Replacing the spur gear with the helical gear can increase the length of the gear teeth (tooth trace) and the thickness of the gear teeth in the rotational direction. This can increase the strength of the gear in the rotational direction and can prevent slippage. Replacing the spur gear with the helical gear can also increase the engagement ratio, that is, the number of gear teeth that are engaged simultaneously. Accordingly, it is possible to distribute the force applied to the gear teeth to a greater number of teeth, and to further prevent gear slippage.

Figure 12:
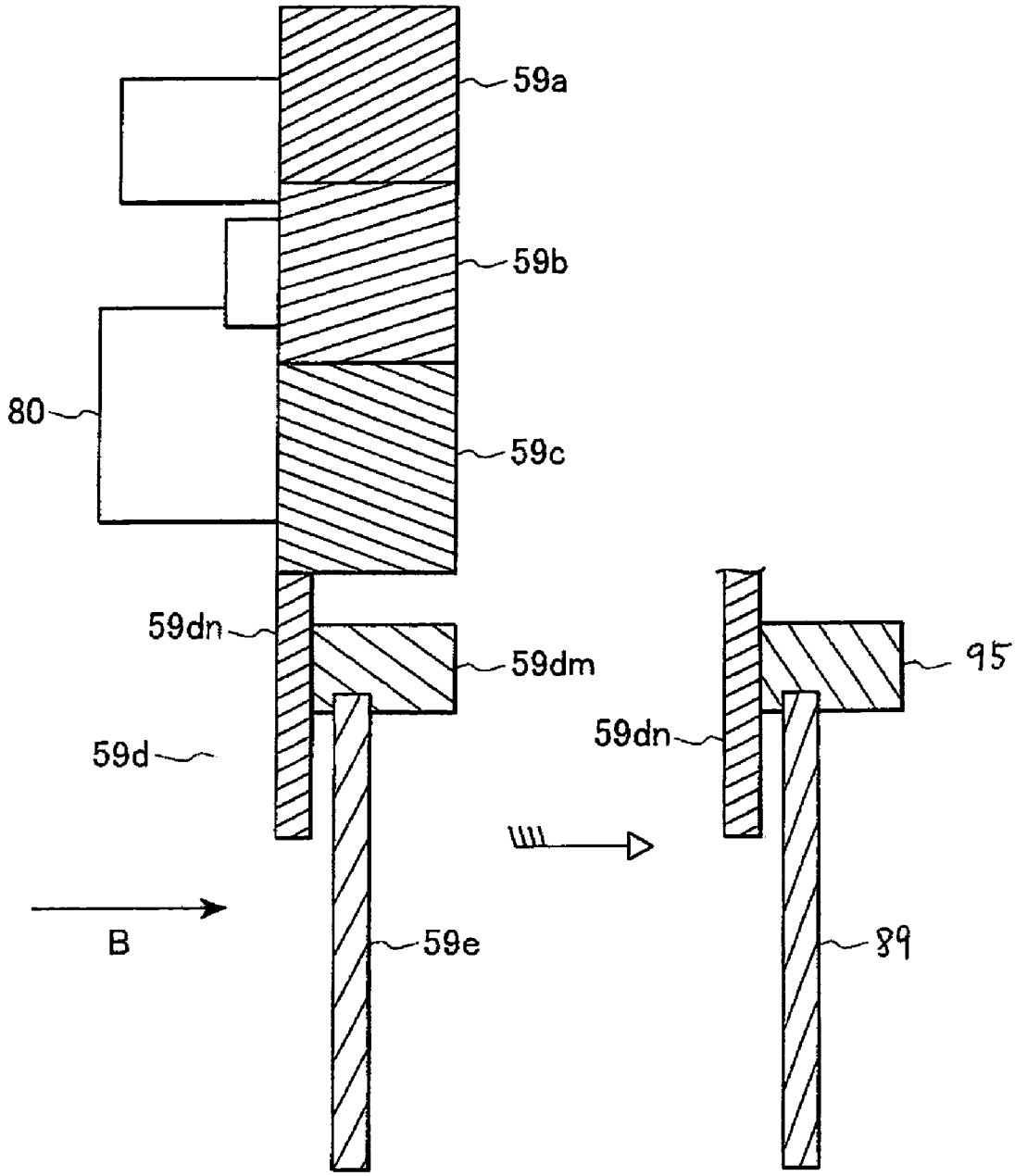
FIG. 12 shows how to replace an agitator drive gear and a small intermediate gear of helical gears with other helical gears with greater helix angles according to another additional aspect.

Or, all the gears in the gear mechanism 59 may be originally helical gears as shown in FIG. 12. In this case, one or more desirable sets of gears that are engaged with one another in the gear mechanism 59 may be replaced with helical gears having a greater helix angle of the teeth. In the example shown in FIG. 12, the agitator drive gear 59*e* and small intermediate gear 59*dm* are replaced with other helical gears 89 and 95 with a greater helix angle than the original helical gears.

This can also increase the length of the gear teeth (tooth trace) and the thickness of the teeth in the rotational direction, thereby increasing the strength of the gear in the rotational direction and preventing slippage. Further, this can also increase the engagement ratio, thereby distributing the force applied to the gear teeth to more number of gear teeth and further preventing gear slippage.

Figure 13:
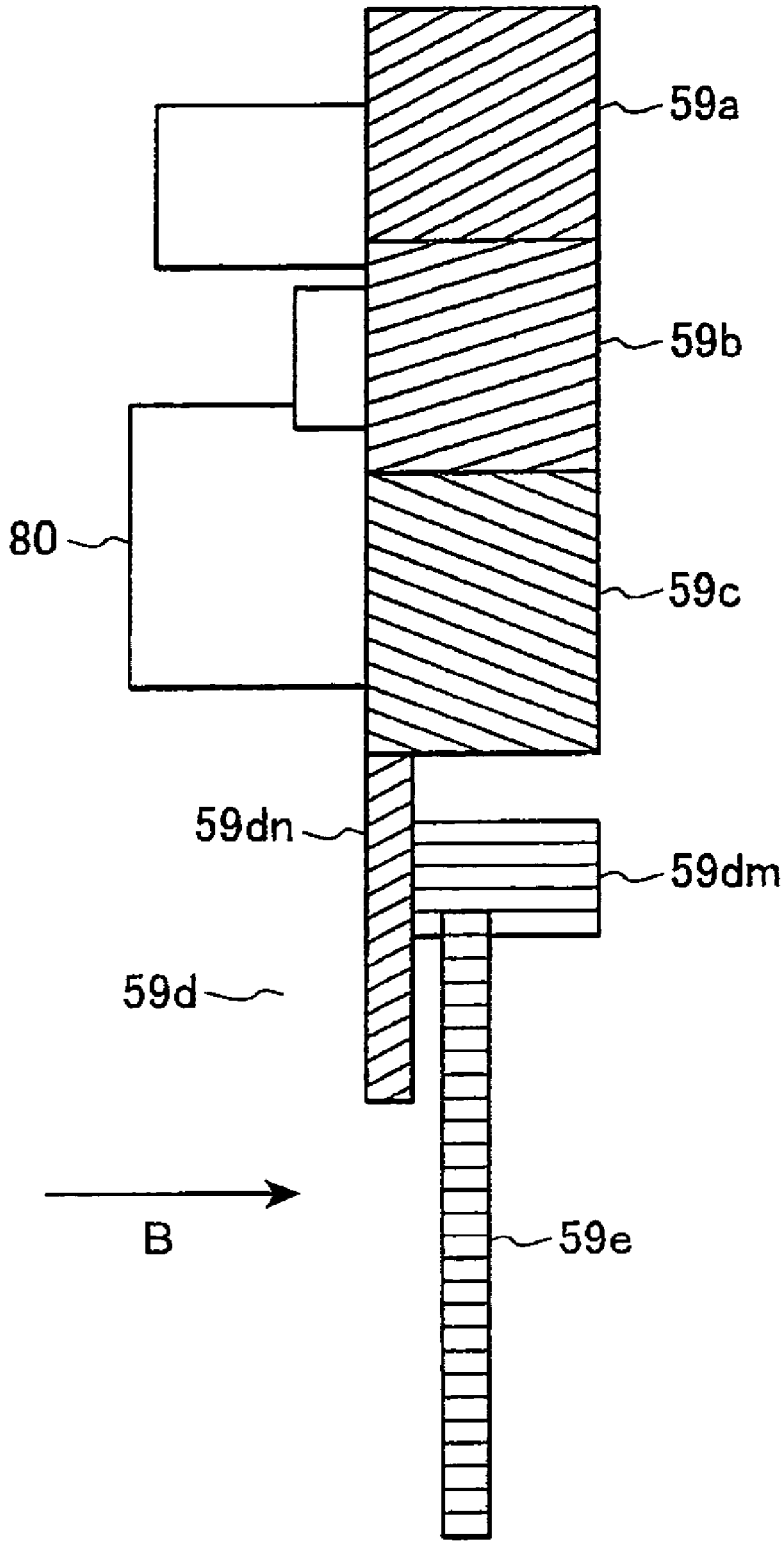
FIG. 13 shows a modification of the gear mechanism that uses helical gears.

Or, any one or more desirable sets of gears in the gear mechanism 59 may be originally helical gears and other remaining one or more desirable sets of gears may be originally spur gears. For example, as shown in FIG. 13, originally, the gears 59*a*, 59*b*, 59*c*, and 59*dn* may be helical gears, while the gears 59*dm* and 59*e* are spur gears.

In this case, one or more desirable sets of gears among the gears 59*a*, 59*b*, 59*c*, and 59*dn* may be replaced with helical gears with a greater helix angle of teeth, and the gears 59*dm* and 59*e* may be replaced with helical gears.

The gears in the gear mechanism 59 may be of any other desirable types of gears.

Marks may be printed on or attached to the replacement gears to indicate that the replacement gears are used for recycling the developer cartridge 24. Colors of the replacement gears may be differentiated from those of the original gears. Other various methods can be applied to the replacement gears to distinguish the replacement gears from the original gears. Observing the gears mounted on the developer cartridges 24, the manufacturer can easily know whether the developer cartridges 24 are reused products or non-reused products.

Similarly, the bearings 90 that are provided in place of the used bearings 90 to recycle the developer cartridge 24 may be distinguished from the used bearings 90 in the same manner as described above. Observing the bearings 90 mounted on the developer cartridges 24, the manufacturer can easily know whether the developer cartridges 24 are reused products or non-reused products.

Further, rather than throwing away the used gears when reusing a developer cartridge 24, the used gears may be mounted in a separate developer cartridge for which the gears are appropriate. In this way, the used gears can be reused, reducing the burden on the environment and saving on manufacturing costs.

Further, reusing the developer cartridge 24 need not include the step of refilling the developer cartridge 24 with toner. In other words, reusing the developer cartridge 24 may include merely replacement of the gears.

Similarly, reusing the developer cartridge 24 need not include the step of replacing the gears or the step of refilling the developer cartridge 24 with toner. In other words, reusing the developer cartridge 24 may include merely replacement of at least one of the pair of bearings 90. Or, reusing the developer cartridge 24 may include merely addition of the sliding member 92, that is, a step of interposing the sliding member 92 between the rotational shaft 93 and the surface of the gear 59*c* opposing the rotational shaft 93. Or, reusing the developer cartridge 24 may include both of the replacement of at least one of the pair of bearings 90 and the addition of the sliding member 92.

Or, reusing the developer cartridge 24 need not include the step of replacing the gears. That is, reusing the developer cartridge 24 may perform the step of refilling the developer cartridge 24 with toner, while replacing at least one of the pair of bearings 90. Or, reusing the developer cartridge 24 may perform the step of refilling the developer cartridge 24 with toner, while adding the sliding member 92.

Or, reusing the developer cartridge 24 may perform the step of refilling the developer cartridge 24 with toner and replacing at least one of the pair of bearings 90, while replacing at least one of the used gears 59*a*-59*e* with new gears 59*a*-59*e* that have never been used for the developer cartridge 24. Or, reusing the developer cartridge 24 may perform the step of refilling the developer cartridge 24 with toner and adding the sliding member 92, while replacing at least one of the used gears 59*a*-59*e* with new gears 59*a*-59*e*.

Or, reusing the developer cartridge 24 may include only the step of interposing some sliding member between some rotational shaft and the surface of a gear opposing the rotational shaft.

The developer cartridge 24 may be reused a plurality of times, while executing at each recycling stage one or more of the following steps: replacement of one or more gears to one or more gears of greater modules; replacement of one or more gears to one or more gears of greater axial thickness; replacement of one or more gears to one or more gears with a gear ratio that cause a slower peripheral speed; replacement of one or more gears to one or more gears with at least a part of each gear tooth being wider in the rotational direction; replacement of one or more gears to one or more gears formed of glass fiber reinforced resin; replacement of one or more spur gears to one or more helical gears; replacement of one or more helical gears to one or more helical gears with a greater helix angle; replacement of the bearings 90 to new bearings; and addition of the sliding member 92.

For example, the developer cartridge 24 may be reused a plurality of times, while gradually increasing the module of at least one gear. The developer cartridge 24 may be reused a plurality of times, while gradually increasing the width of at least a part of each tooth of at least one gear in the rotational direction. The developer cartridge 24 may be reused a plurality of times, while gradually increasing the axial thickness of at least one gear. The developer cartridge 24 may be reused a plurality of times, while gradually increasing the helix angle of at least one gear. The developer cartridge 24 may be reused a plurality of times, while gradually decreasing the peripheral speed of one or more gears.

In the above description, the drum cartridge 38 is detachably mounted to the developer cartridge 24. However, the drum cartridge 38 may be fixedly secured to the developer cartridge 24.

The developer cartridge 24 may be modified in various manners so long as the developer cartridge 24 can be detachably mounted in the laser printer 1 and so long as the developer cartridge 24 includes at least the developing roller 27 and gears for transferring a driving force inputted from the laser printer 1 to the developing roller 27. For example, the developer cartridge 24 may be modified to include not only the developing roller 27 but also the photosensitive drum 23.

The laser printer 1 may be modified into any types of image-forming device, such as a facsimile device, multifunction device, or the like that employs an electrophotographic process.

The replacement gears 83 and 86 (FIG. 9(*b*)) may be designed to have a larger module than the original gears 59*a* and 59*b* (FIG. 9(*a*)) similarly to the replacement gears 81 and 82*n* (FIG. 7). The replacement gears 83 and 86 may be designed to have at least a part of each tooth wider in the rotational directions than the original gears 59*a* and 59*b*.

The replacement gears 84 and 85*m* (FIG. 10) may be designed thicker than the original gears 95*a* and 95*c* along their rotational axial directions similarly to the replacement gears 83 and 86 (FIG. 9(*b*)). The replacement gears 84 and 85*m* may be designed to have a larger module than the original gears 95*a* and 95*c* similarly to the replacement gears 81 and 82 (FIG. 7). The replacement gears 84 and 85*m* may be designed to have at least a part of each tooth wider in the rotational directions thereof than the original gears 59*a* and 59*b*.

When the original spur gears are replaced with helical gears, the helical gears may be designed to have a larger module than the original spur gears, to have at least a part of each tooth wider in the rotational directions than the original spur gears, to have a greater axial thickness than the original spur gears, or to have a gear ratio that causes one of the helical gears to rotate with a decreased speed similarly to the replacement gears 84 and 85*m* (FIG. 10).

Similarly, when the original helical gears are replaced with other helical gears with a larger helix angle, the replacement helical gears may be designed to have a larger module than the original helical gears, to have at least a part of each tooth wider in the rotational directions than the original helical gears, to have a greater axial thickness than the original helical gears, or to have a gear ratio that causes one of the replacement helical gears to rotate with a decreased speed.

What is claimed is:

1. A method of reusing a developing device that can be detachably mounted in a body of an image-forming device, the method comprising:

preparing a used developing device that comprises a developer-carrying member that carries a developer thereon, and a gear mechanism having a plurality of gears that transfer a driving force inputted from the image-forming device to the developer-carrying member; and replacing at least one gear in the gear mechanism with at least one replacement gear that has stronger gear teeth than the at least one original gear, wherein the replacing step includes replacing a set of gears that are engaged with one another among the plurality of gears with a set of replacement gears that are engaged with one another and that have a larger module than the original gears.

2. A method of reusing a developing device according to claim 1, wherein the plurality of gears include a developer-carrying-member drive gear fixed to the developer-carrying member, and an input gear that is engaged with the developer-carrying-member drive gear and that transfers a driving force inputted from the image-forming device to the developer roller drive gear, and wherein the set of gears include the developer-carrying-member drive gear and the input gear, the gear replacing step replacing the developer-carrying-member drive gear and the input gear with the replacement gears having a larger module, without replacing other gears in the gear mechanism.

3. A method of reusing a developing device according to claim 1, wherein at least a part of each gear tooth in each replacement gear being wider in a rotational direction thereof than that in the corresponding original gear.

4. A method of reusing a developing device according to claim 1, wherein each replacement gear having gear teeth wider in a rotational axial direction thereof than the corresponding original gear.

5. A method of reusing a developing device according to claim 1, wherein the replacement gear has gear teeth made of glass fiber reinforced resin.

6. A method of reusing a developing device according to claim 1, wherein the developing device further comprises a filling chamber that accommodates the developer; and further comprising refilling the filling chamber with replacement developer.

7. A method of reusing a developing device according to claim 6, wherein the replacement developer has less fluidity than the original developer.

8. A method of reusing a developing device according to claim 1, wherein the at least one replacement gear is distinguishable from the at least one original gear.

9. A method of reusing a developing device according to claim 1, further comprising replacing, with another bearing, a bearing that is supported by a housing of the developing device and that rotatably supports a rotational shaft, on which a gear in the gear mechanism is fixed.

10. A method of reusing a developing device according to claim 9:

wherein the developer-carrying member is rotatably supported by the housing of the used developing device and the plurality of gears are rotatably supported by the housing of the used developing device.

11. A method of reusing a developing device according to claim 10, wherein the plurality of gears include a developer-carrying-member drive gear fixed to the developer-carrying member, and an input gear that is engaged with the developer-carrying-member drive gear and that transfers a driving force inputted from the image-forming device to the developer roller drive gear, and wherein the bearing replacing step replaces, with the another bearing, the bearing that rotatably supports the rotational shaft of the developer-carrying member, on which the developer-carrying-member drive gear is fixed.

12. A method of reusing a developing device according to claim 10, wherein the developing device further comprises a filling chamber that accommodates the developer; and further comprising refilling the filling chamber with replacement developer.

13. A method of reusing a developing device according to claim 12, wherein the replacement developer has less fluidity than the original developer.

14. A method of reusing a developing device according to claim 10, wherein the another bearing is distinguishable from the original bearing.

15. A method of reusing a developing device according to claim 1:

the method further comprising interposing a sliding member between a rotational shaft, on which a gear in the gear mechanism is rotatably supported, and a surface of the gear that opposes the peripheral surface of the rotational shaft.

16. A method of reusing a developing device according to claim 15, wherein the plurality of gears include a developer-carrying-member drive gear fixed to the developer-carrying member, and an input gear that is engaged with the developer-carrying-member drive gear and that transfers a driving force inputted from the image-forming device to the developer roller drive gear, and wherein the sliding member interposing step interposes the sliding member between a rotational shaft, on which the input gear is rotatably supported, and a surface of the input gear that opposes the peripheral surface of the rotational shaft.

17. A method of reusing a developing device according to claim 15, wherein the developing device further comprises a filling chamber that accommodates the developer; and further comprising refilling the filling chamber with replacement developer.

18. A method of reusing a developing device according to claim 17, wherein the replacement developer has less fluidity than the original developer.

19. A method of reusing a developing device that can be detachably mounted in a body of an image-forming device, the method comprising:

preparing a used developing device that comprises a developer-carrying member that carries a developer thereon, and a gear mechanism having a plurality of gears that transfer a driving force inputted from the image-forming device to the developer-carrying member; and replacing a set of gears that are engaged with one another among the plurality of gears with a set of replacement gears that are engaged with one another and that have gear teeth with a greater working depth than the original gears.

20. A method of reusing a developing device according to claim 19, wherein the developing device further comprises a filling chamber that accommodates the developer; and further comprising refilling the filling chamber with replacement developer.

21. A method of reusing a developing device according to claim 20, wherein the replacement developer has less fluidity than the original developer.

22. A developing device that can be detachably mounted in a body of an image-forming device, the developing device comprising:

a developer-carrying member that carries a developer thereon; and a gear mechanism having a plurality of gears that transfers a driving force inputted from the image-forming device to the developer-carrying member, the gear mechanism includes at least one set of replacement gears that are engaged with one another and that are provided in place of at least one set of original gears that have been provided previously in engagement with one another, the replacement gears having a larger module than the original gears.

23. A developing device according to claim 22, wherein the plurality of gears include a developer-carrying-member drive gear fixed to the developer-carrying member, and an input gear that is engaged with the developer-carrying-member drive gear and that transfers a driving force inputted from the image-forming device to the developer roller drive gear, and wherein the replacement gears are provided in place of the original gears for the developer-carrying-member drive gear and the input gear, the replacement gears for the developer-carrying-member drive gear and the input gear having a larger module than the original gears for the developer-carrying-member drive gear and the input gear.

24. A developing device according to claim 22, wherein at least a part of each gear tooth in each replacement gear is wider in a rotational direction thereof than that in the corresponding original gear.

25. A developing device according to claim 22, wherein the replacement gears have gear teeth wider in a rotational axial direction thereof than the original gears.

26. A developing device according to claim 22, wherein the replacement gear has gear teeth made of glass fiber reinforced resin.

27. A developing device according to claim 22, further comprising a filling chamber that accommodates developer, the filling chamber being refilled with replacement developer.

28. A developing device according to claim 27, wherein the replacement developer has less fluidity than original developer that has been filled in the filling chamber previously.

29. A developing device according to claim 22, wherein the at least one replacement gear is distinguishable from the at least one original gear.

30. A developing device according to any one of claim 22, further comprising:

a housing; and a bearing that is supported by the housing and that rotatably supports a rotational shaft, on which a gear in the gear mechanism is fixed;

wherein the bearing is provided in place of a corresponding original bearing that has been provided previously.

31. A developing device according to claim 30, wherein the bearing is distinguishable from the original bearing.

32. A developing device according to claim 22, further comprising an image-forming member that forms an electrostatic latent image thereon, the developer-carrying member transferring the developer to the image-forming member, thereby developing the electrostatic latent image into a visible image.

33. An image forming apparatus, comprising:

a body; and a developing device according to claim 22.

34. A developing device according to claim 30:

wherein the developer-carrying member is rotatably supported by the housing and;

the plurality of gears are rotatably supported by the housing.

35. A developing device according to claim 34, wherein the plurality of gears include a developer-carrying-member drive gear fixed to the developer-carrying member, and an input gear that is engaged with the developer-carrying-member drive gear and that transfers a driving force inputted from the image-forming device to the developer roller drive gear, and the bearing is supported by the body of the developing device and rotatably supports the rotational shaft of the developer-carrying member, on which the developer-carrying-member drive gear is fixed.

36. A developing device according to claim 34, further comprising a filling chamber that accommodates developer, the filling chamber being refilled with replacement developer.

37. A developing device according to claim 36, wherein the replacement developer has less fluidity than original developer that has been filled in the filling chamber previously.

38. A developing device according to claim 34, wherein the bearing is distinguishable from the original bearing.

39. A developing device according to claim 22:

further comprising a sliding member interposed between a rotational shaft, on which gear in the gear mechanism is rotatably supported, and a surface of the gear that opposes the peripheral surface of the rotational shaft.

40. A developing device according to claim 39, wherein the plurality of gears include a developer-carrying-member drive gear fixed to the developer-carrying member, and an input gear that is engaged with the developer-carrying-member drive gear and that transfers a driving force inputted from the image-forming device to the developer roller drive gear, the sliding member is interposed between a rotational shaft, on which the input gear is rotatably supported, and a surface of the input gear that opposes the peripheral surface of the rotational shaft.

41. A developing device according to claim 39, further comprising a filling chamber that accommodates developer, the filling chamber being refilled with replacement developer.

42. A developing device according to claim 41, wherein the replacement developer has less fluidity than original developer that has been filled in the filling chamber previously.

43. A developing device that can be detachably mounted in a body of an image-forming device, the developing device comprising:

a developer-carrying member that carries a developer thereon; and a gear mechanism having a plurality of gears that transfers a driving force inputted from the image-forming device to the developer-carrying member, the gear mechanism including at least one set of replacement gears that are engaged with one another and that are provided in place of at least one set of original gears that have been provided previously in engagement with one another, the replacement gears having gear teeth with a greater working depth than the original gears.

44. A developing device according to claim 43, further comprising a filling chamber that accommodates developer, the filling chamber being refilled with replacement developer.

45. A developing device according to claim 44, wherein the replacement developer has less fluidity than original developer that has been filled in the filling chamber previously.

* * * * *